US010584894B2

(12) United States Patent
Iwano et al.

(10) Patent No.: US 10,584,894 B2
(45) Date of Patent: Mar. 10, 2020

(54) AIR CONDITIONER AND CONTROL CIRCUIT

(71) Applicant: FUJITSU GENERAL LIMITED, Kanagawa (JP)

(72) Inventors: Syun Iwano, Kanagawa (JP); Tomofumi Kawai, Kanagawa (JP); Satoru Tokuda, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 342 days.

(21) Appl. No.: 14/654,836

(22) PCT Filed: Dec. 27, 2013

(86) PCT No.: PCT/JP2013/085045
§ 371 (c)(1),
(2) Date: Jun. 22, 2015

(87) PCT Pub. No.: WO2014/104275
PCT Pub. Date: Jul. 3, 2014

(65) Prior Publication Data

US 2015/0354850 A1 Dec. 10, 2015

(30) Foreign Application Priority Data

Dec. 28, 2012 (JP) ..... 2012-288432

(51) Int. Cl.
*F24F 13/14* (2006.01)
*F24F 13/15* (2006.01)
(Continued)

(52) U.S. Cl.
CPC ..... *F24F 13/14* (2013.01); *F24F 1/0011* (2013.01); *F24F 11/74* (2018.01); *F24F 11/79* (2018.01); *F24F 13/15* (2013.01); *F24F 13/20* (2013.01)

(58) Field of Classification Search
CPC ..... F24F 11/04; F24F 1/0011; F24F 13/14; F24F 13/15; F24F 13/20; F24F 11/0078
(Continued)

(56) References Cited

U.S. PATENT DOCUMENTS 2,235,500 A 3/1941 Kitchen
2,640,412 A 6/1953 Sweger
(Continued)

FOREIGN PATENT DOCUMENTS

DE 102011112109 A1 3/2013
EP 1726889 A1 11/2006
(Continued)

OTHER PUBLICATIONS

Morimoto, Chiaki; JP2002022198 translation.pdf, "Air conditioner", Jan. 2002, pp. 1-14.*
(Continued)

*Primary Examiner* — Grant Moubry
*Assistant Examiner* — Ryan L Faulkner
(74) *Attorney, Agent, or Firm* — McDermott Will & Emery LLP

(57) ABSTRACT

Air-blowing from a second air outlet is effectively used. An air conditioner includes a main body unit and an auxiliary housing. The main body unit forms a first air outlet which blows out a cool or warm airflow. The auxiliary housing is attached to at least one side of the first air outlet to be freely movable, and forms a second air outlet which blows out taken-in indoor air. A control circuit blows out the indoor air from the second air outlet at a wind speed which is higher than the wind speed of cool air or warm air that is blown out of the first air outlet.

7 Claims, 14 Drawing Sheets

(51) Int. Cl.

| | |
|---|---|
| ***F24F 1/0011*** | (2019.01) |
| ***F24F 13/20*** | (2006.01) |
| ***F24F 11/79*** | (2018.01) |
| ***F24F 11/74*** | (2018.01) |

(58) Field of Classification Search
USPC ..... 454/256
See application file for complete search history.

(56) References Cited

U.S. PATENT DOCUMENTS

| | | | | |
|---|---|---|---|---|
| 2,977,870 | A | 4/1961 | Bierwirth et al. | |
| 2,999,370 | A | 9/1961 | Eberhart | |
| 5,014,610 | A | 5/1991 | Twito | |
| 5,242,325 | A | 9/1993 | Nukushina | |
| 5,251,814 | A | 10/1993 | Warashina et al. | |
| 5,467,606 | A * | 11/1995 | Sasaki | F24F 1/0007 165/127 |
| 5,547,018 | A | 8/1996 | Takahashi et al. | |
| 6,283,380 | B1 | 9/2001 | Nakanishi et al. | |
| 6,338,382 | B1 | 1/2002 | Takahashi et al. | |
| 9,250,028 | B2 | 2/2016 | Taira et al. | |
| 2005/0279120 | A1 | 12/2005 | Lee et al. | |
| 2005/0284170 | A1 | 12/2005 | Lee et al. | |
| 2008/0242212 | A1 | 10/2008 | El-Galley et al. | |
| 2008/0242214 | A1 | 10/2008 | Sung | |
| 2009/0107167 | A1 | 4/2009 | Kim et al. | |
| 2009/0114377 | A1 | 5/2009 | Zheng et al. | |
| 2009/0183521 | A1 | 7/2009 | Shibuya et al. | |
| 2010/0132393 | A1 | 6/2010 | Kim et al. | |
| 2010/0168923 | A1 | 7/2010 | Park et al. | |
| 2011/0039491 | A1 | 2/2011 | Khalifa et al. | |
| 2011/0048050 | A1 | 3/2011 | Moteki et al. | |
| 2012/0031983 | A1 * | 2/2012 | Shirota | F24F 1/0011 236/49.3 |
| 2012/0057973 | A1 | 3/2012 | Chen et al. | |
| 2013/0167578 | A1 | 7/2013 | Ikeda et al. | |
| 2013/0255909 | A1 | 10/2013 | Matsumoto | |
| 2013/0284410 | A1 | 10/2013 | Taira et al. | |
| 2013/0284411 | A1 | 10/2013 | Taira et al. | |
| 2013/0284417 | A1 | 10/2013 | Taira et al. | |
| 2014/0041145 | A1 | 2/2014 | Matsumoto | |
| 2015/0338123 | A1 | 11/2015 | Iwano | |
| 2015/0345809 | A1 | 12/2015 | Hayashi et al. | |
| 2015/0377242 | A1 | 12/2015 | Furuhashi et al. | |

FOREIGN PATENT DOCUMENTS

| | | | | |
|---|---|---|---|---|
| EP | 1813880 | A1 | 8/2007 | |
| EP | 2208946 | A1 | 7/2010 | |
| EP | 2416074 | A2 | 2/2012 | |
| JP | 55121342 | | 9/1980 | |
| JP | 5-69521 | | 9/1993 | |
| JP | 2000-297792 | A | 10/2000 | |
| JP | 2002-022198 | A | 1/2002 | |
| JP | 2002022198 | * | 1/2002 | F24F 1/00 |
| JP | 2002-130718 | A | 5/2002 | |
| JP | 2003-130381 | A | 5/2003 | |
| JP | 2004-286235 | A | 10/2004 | |
| JP | 2004286235 | * | 10/2004 | F24F 1/00 |
| JP | 2008-281212 | A | 11/2008 | |
| JP | 2010-164271 | A | 7/2010 | |
| JP | 2010164271 | * | 7/2010 | F24F 13/08 |
| JP | 2011-069524 | A | 4/2011 | |
| JP | 2011069524 | * | 4/2011 | F24F 1/00 |
| JP | 2012-078031 | A | 4/2012 | |

OTHER PUBLICATIONS

Watanabe, Soichiro; JP2004286235 translation.pdf, "Wall-mounting air conditioner", Oct. 2004, pp. 1-6.*
Eguchi, Osamu; JP2010164271 translation.pdf, "Air conditioning equipment", Jul. 2010, pp. 1-15.*
Mishima, Takechika; JP2011069524 translation.pdf, "Air conditioner", Apr. 2011, pp. 1-15.*
Kikuchi, Hiroyuki, JP2003130381 Translation.pdf, "Air Conditioner", Oct. 2001, pp. 1-11.*
Non-final Office Action issued in related U.S. Appl. No. 13/872,830, dated Jul. 8, 2015.
Final Office Action issued in related U.S. Appl. No. 13/872,830, dated Dec. 24, 2015.
Non-final Office Action issued in related U.S. Appl. No. 13/872,875, dated Jun. 22, 2015.
Notice of Allowance issued in related U.S. Appl. No. 13/872,875, dated Oct. 2, 2015.
Non-final Office Action issued in related U.S. Appl. No. 13/872,816, dated Apr. 14, 2016.
International Search Report and Written Opinion, issued in International Patent Application No. PCT/JP2013/085043, dated Apr. 8, 2014; with English translation.
International Preliminary Report on Patentability issued in International Patent Application No. PCT/JP2013/085043, dated Jun. 30, 2015; with English translation.
International Search Report and Written Opinion, issued in International Patent Application No. PCT/JP2013/085044, dated Apr. 8, 2014; with English translation.
International Preliminary Report on Patentability issued in International Patent Application No. PCT/JP2013/085044, dated Jun. 30, 2015; with English translation.
International Search Report and Written Opinion, issued in International Patent Application No. PCT/JP2013/085045, dated Mar. 4, 2014; with English translation.
International Preliminary Report on Patentability issued in International Patent Application No. PCT/JP2013/085045, dated Jun. 30, 2015; with English translation.
Office Action issued in Japanese Patent Application No. 2012-103521, dated Jan. 20, 2016; with English translation.
Office Action issued in Japanese Patent Application No. 2012-103523, dated Mar. 16, 2016; with English translation.
Extended European Search Report EP 13 16 5503 dated Oct. 18, 2011.

* cited by examiner

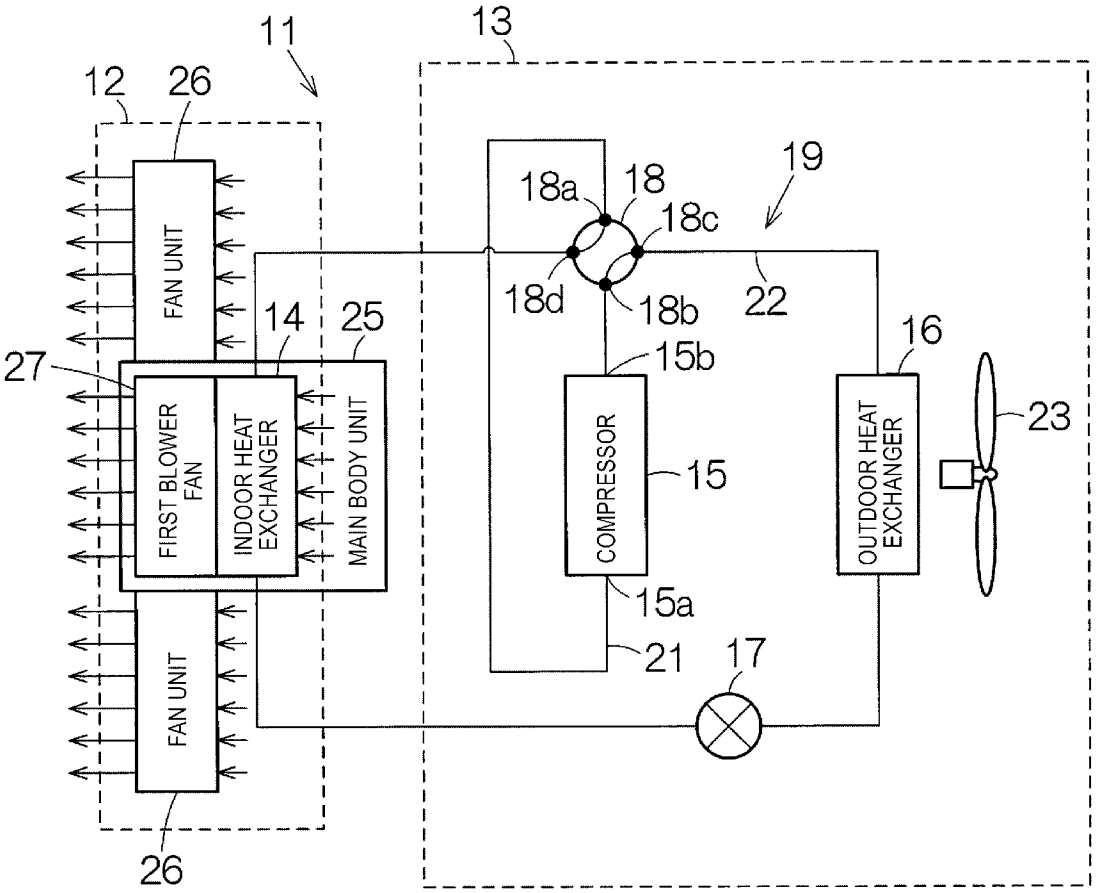
[FIG. 1]

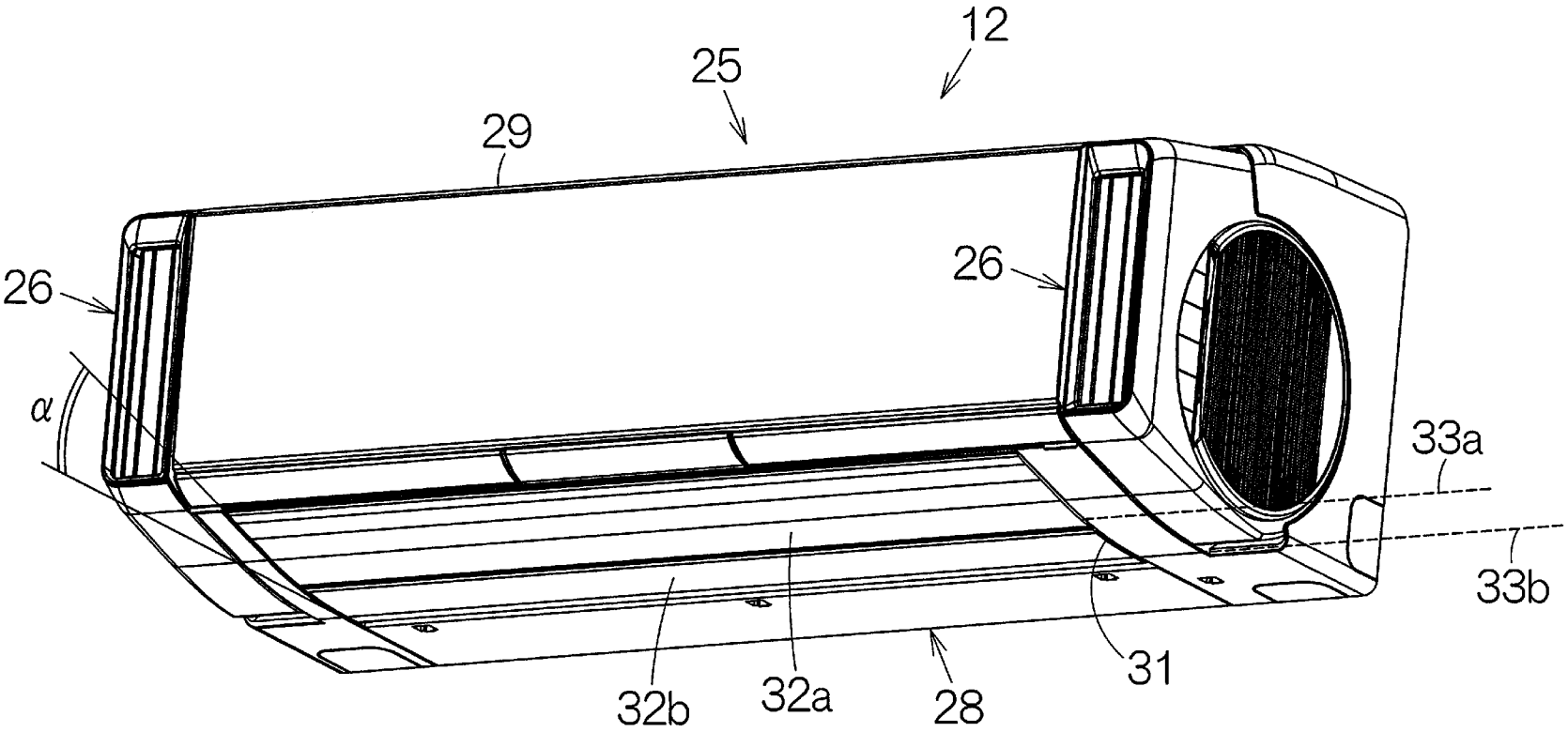
[FIG. 2]

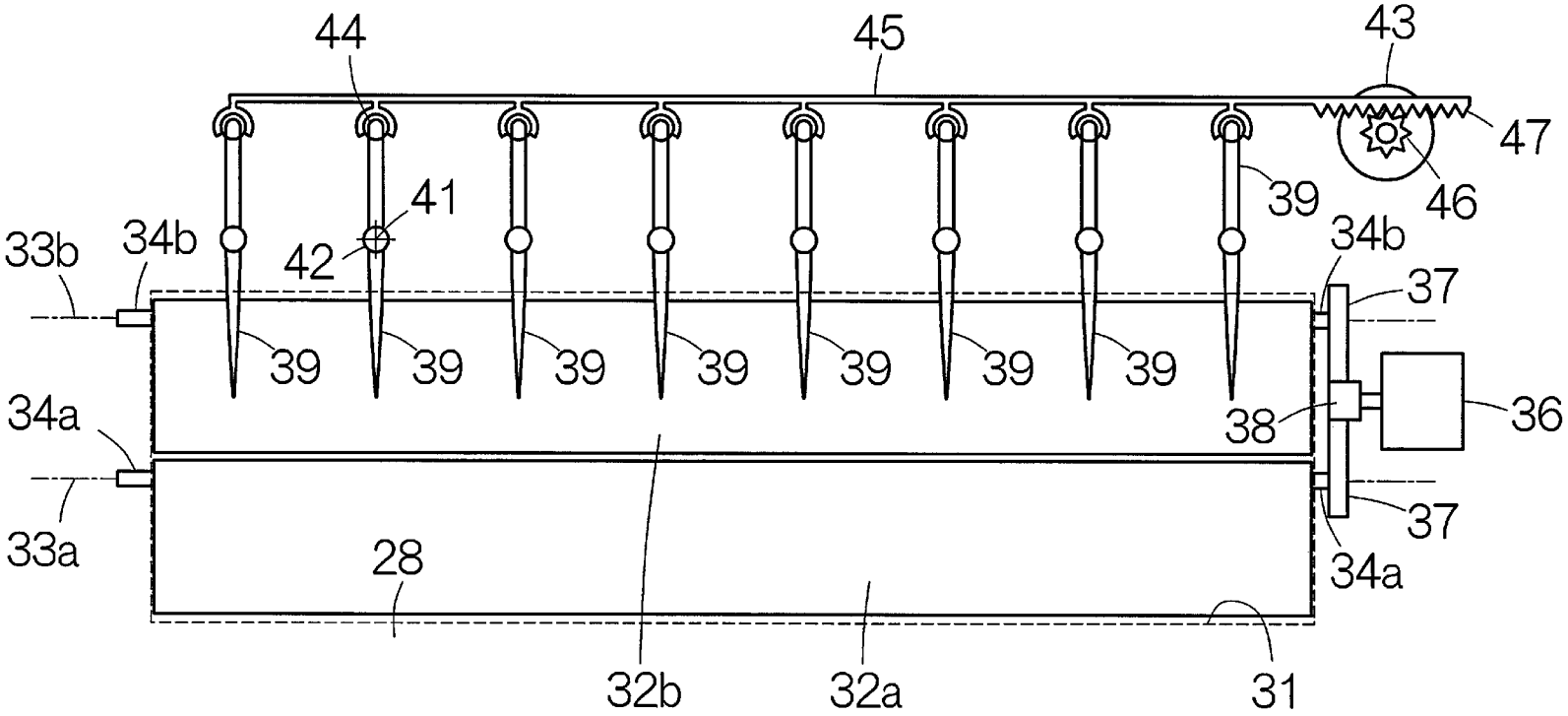
[FIG. 3]

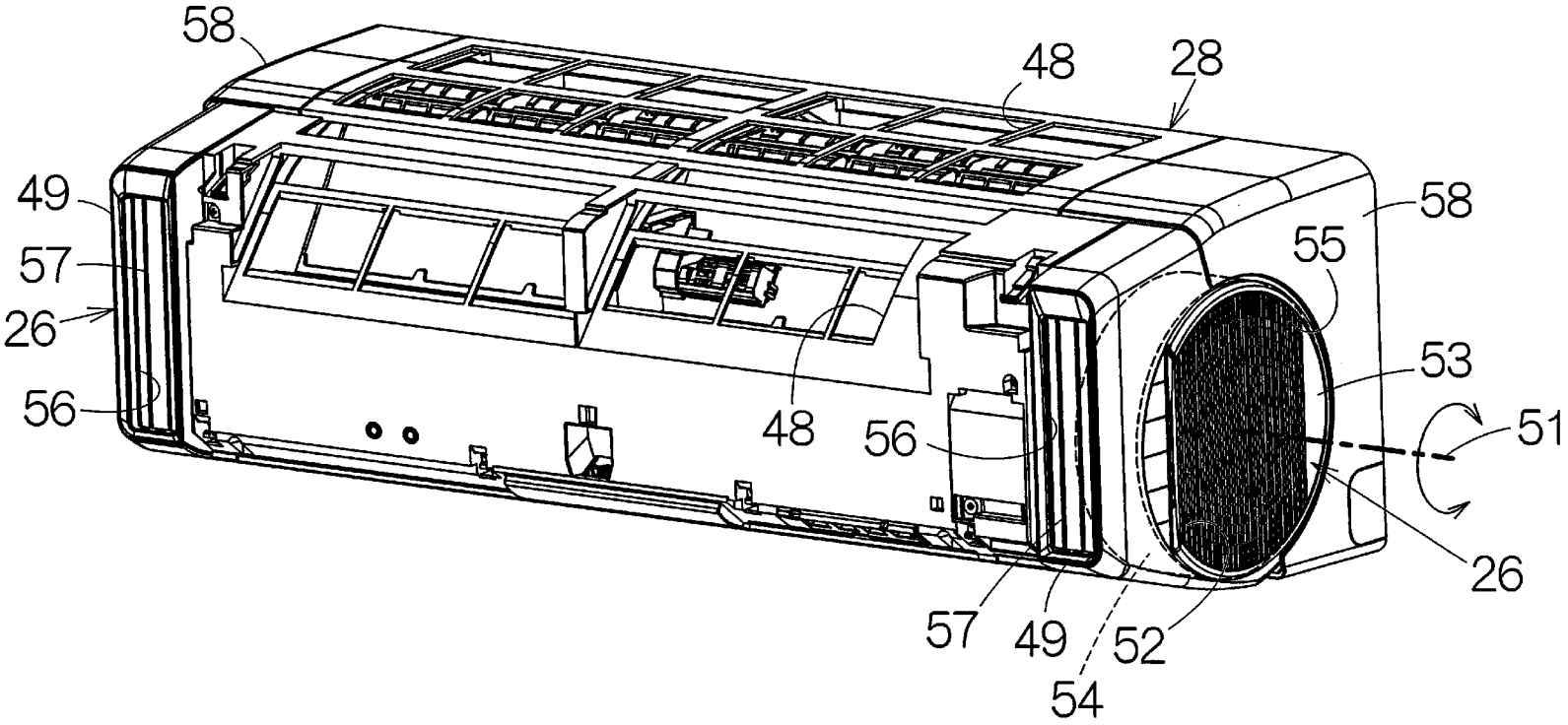
[FIG. 4]

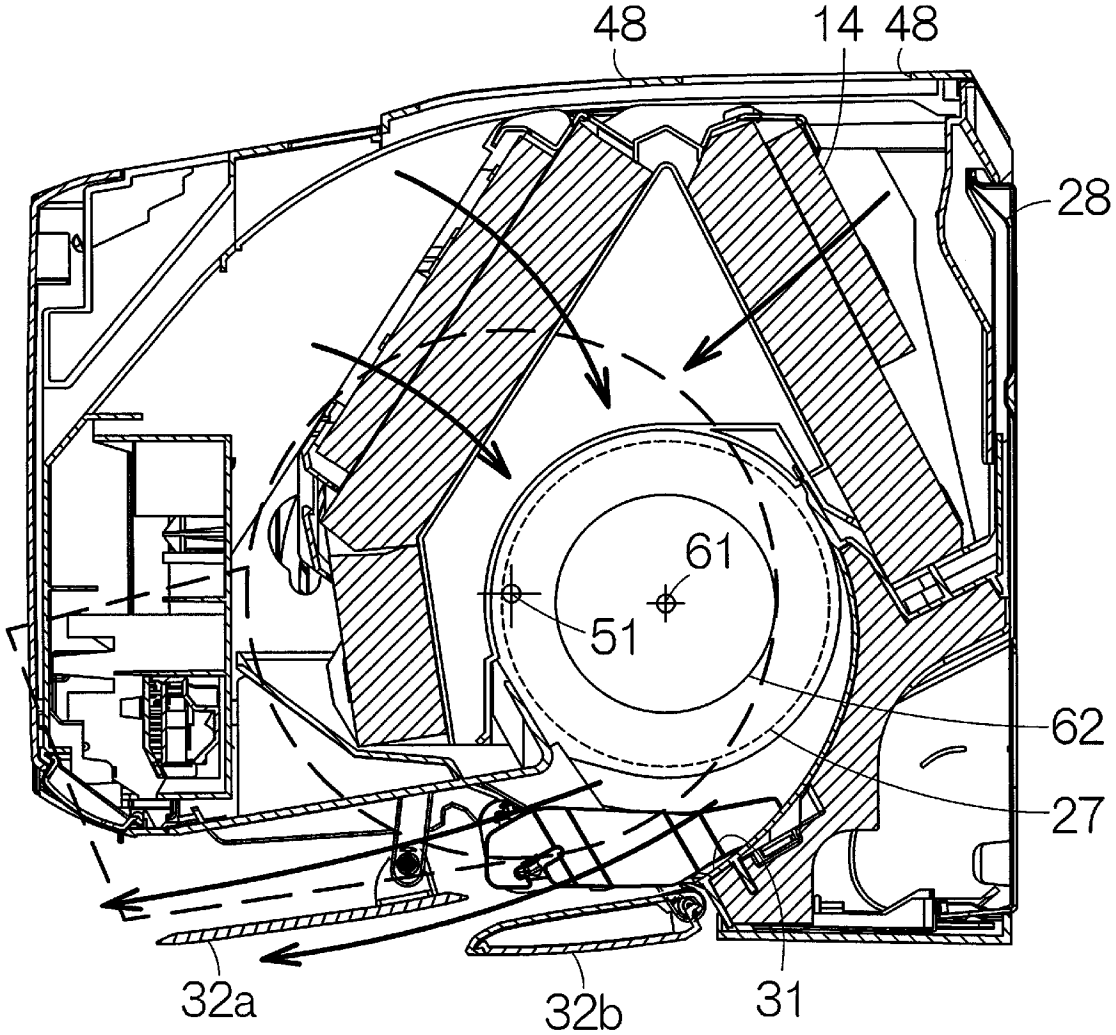
[FIG. 5]

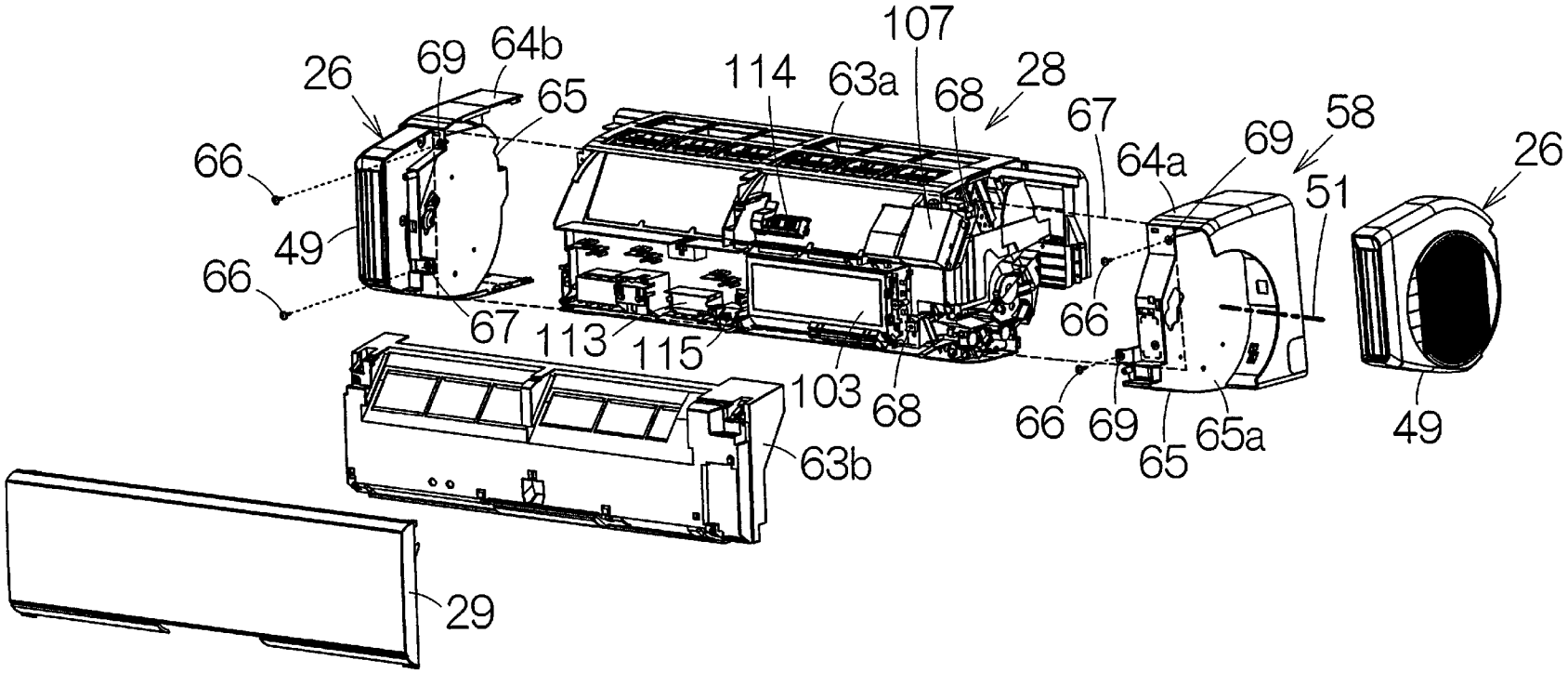
[FIG. 6]

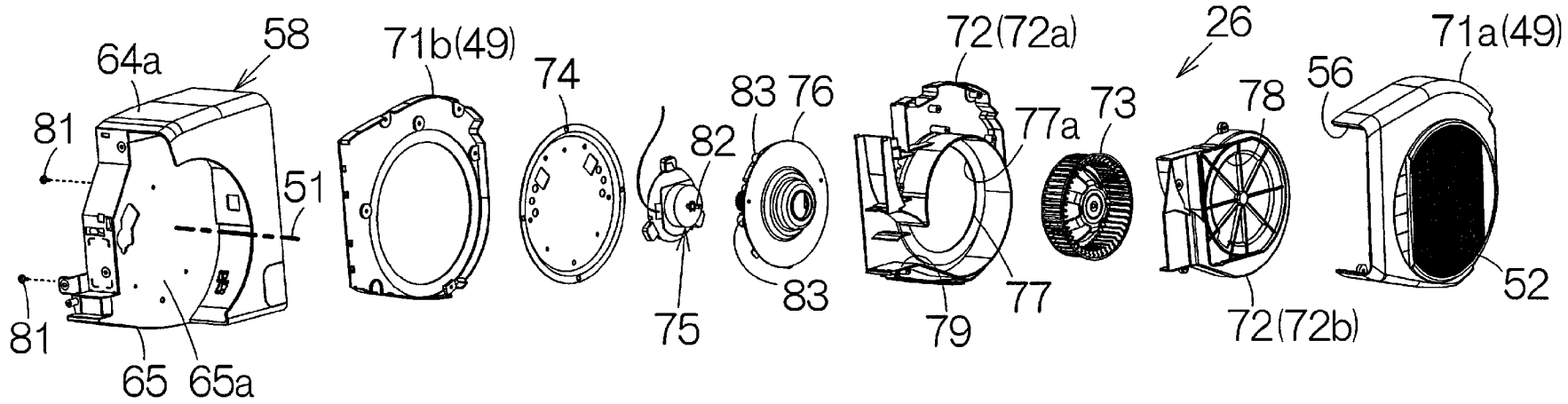
[FIG. 7]

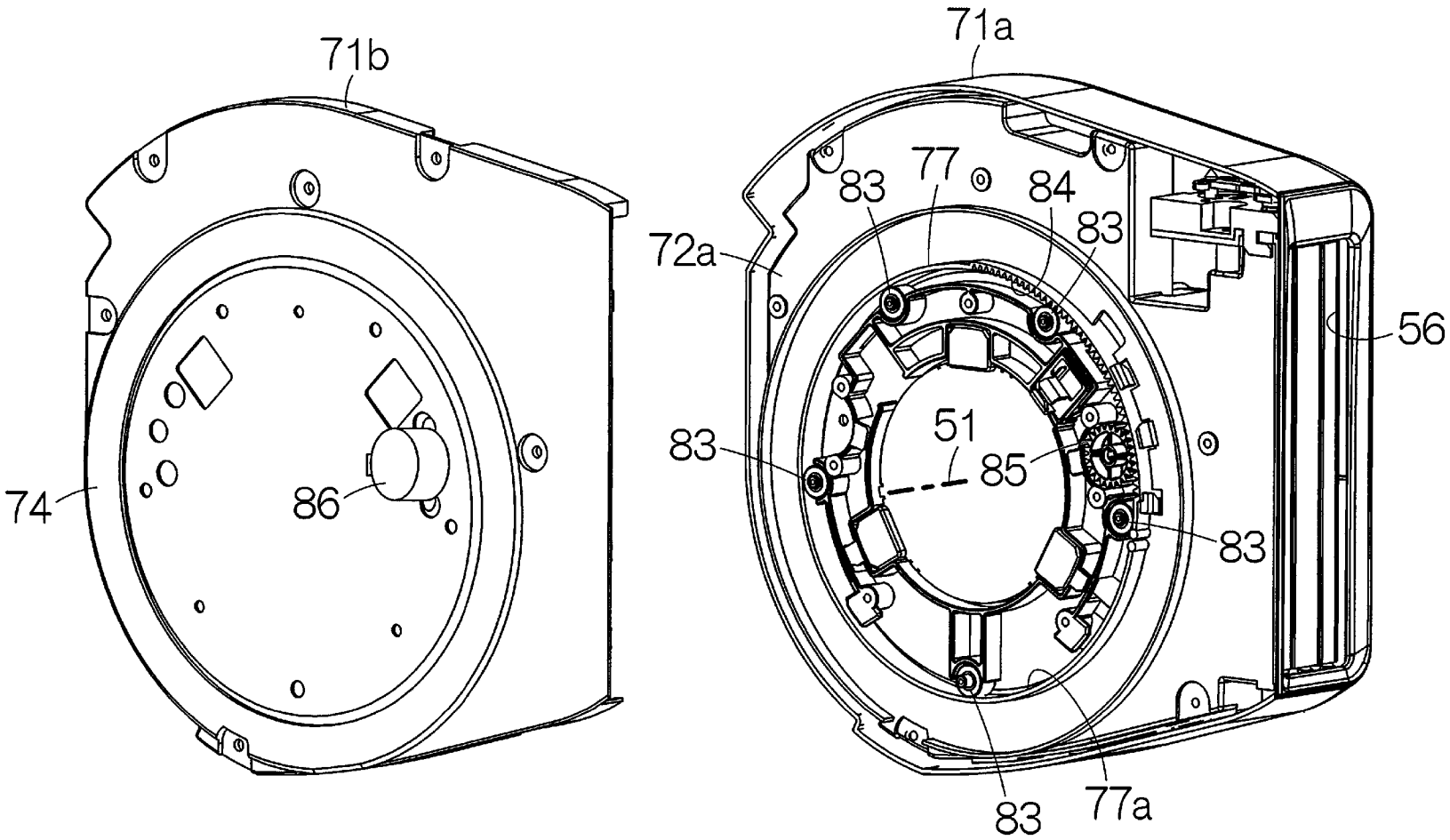
[FIG. 8]

[FIG. 9]
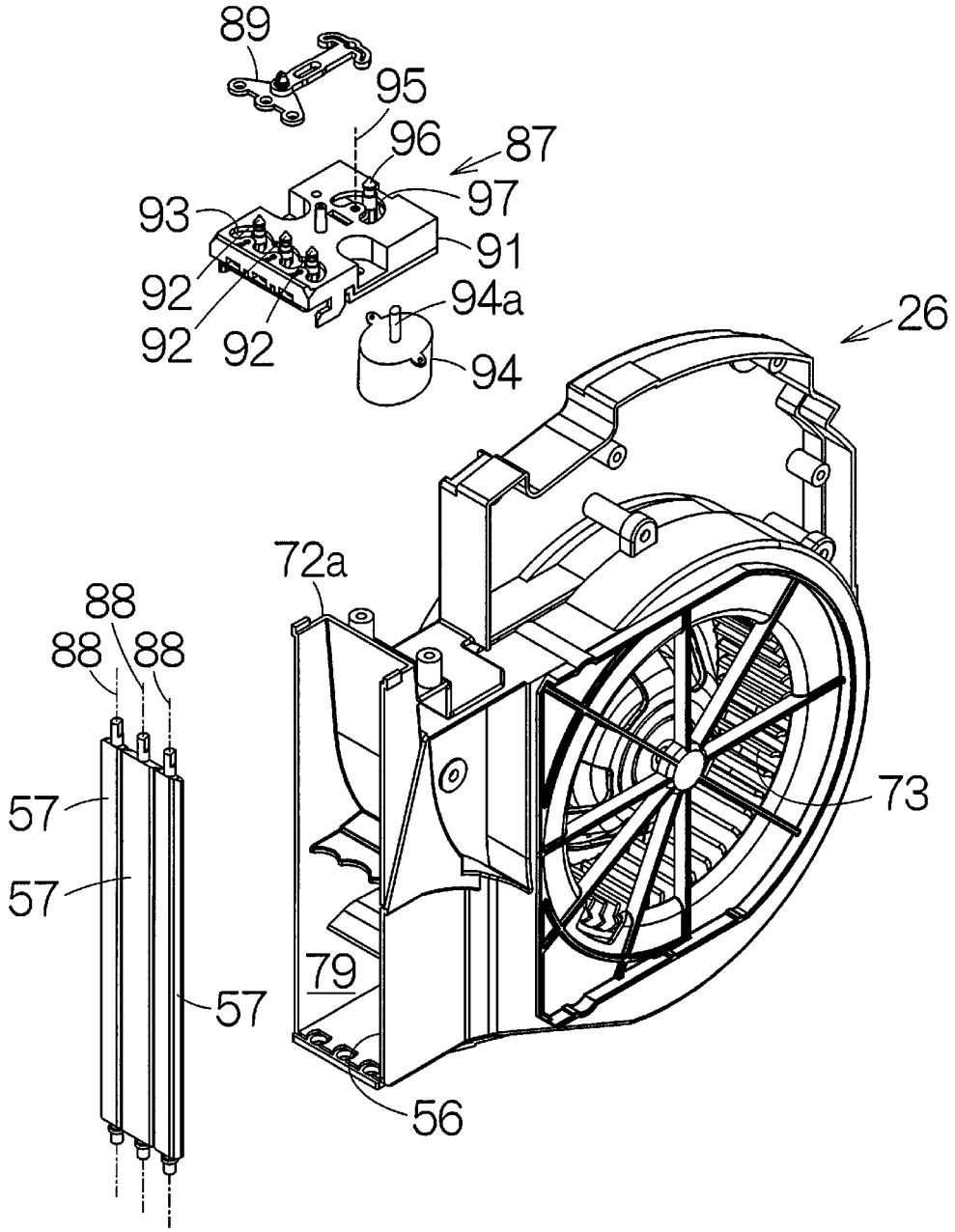

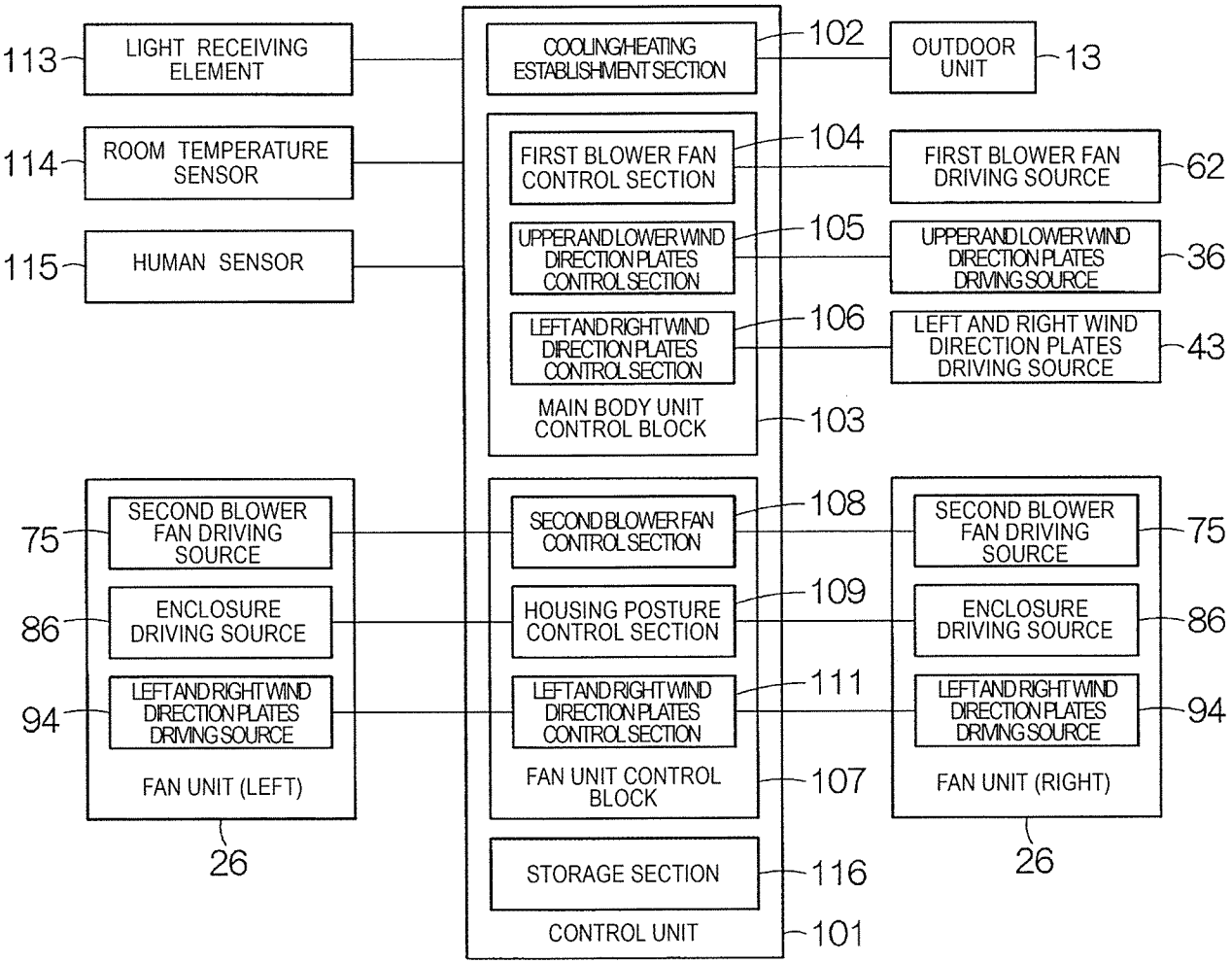
[FIG. 10]

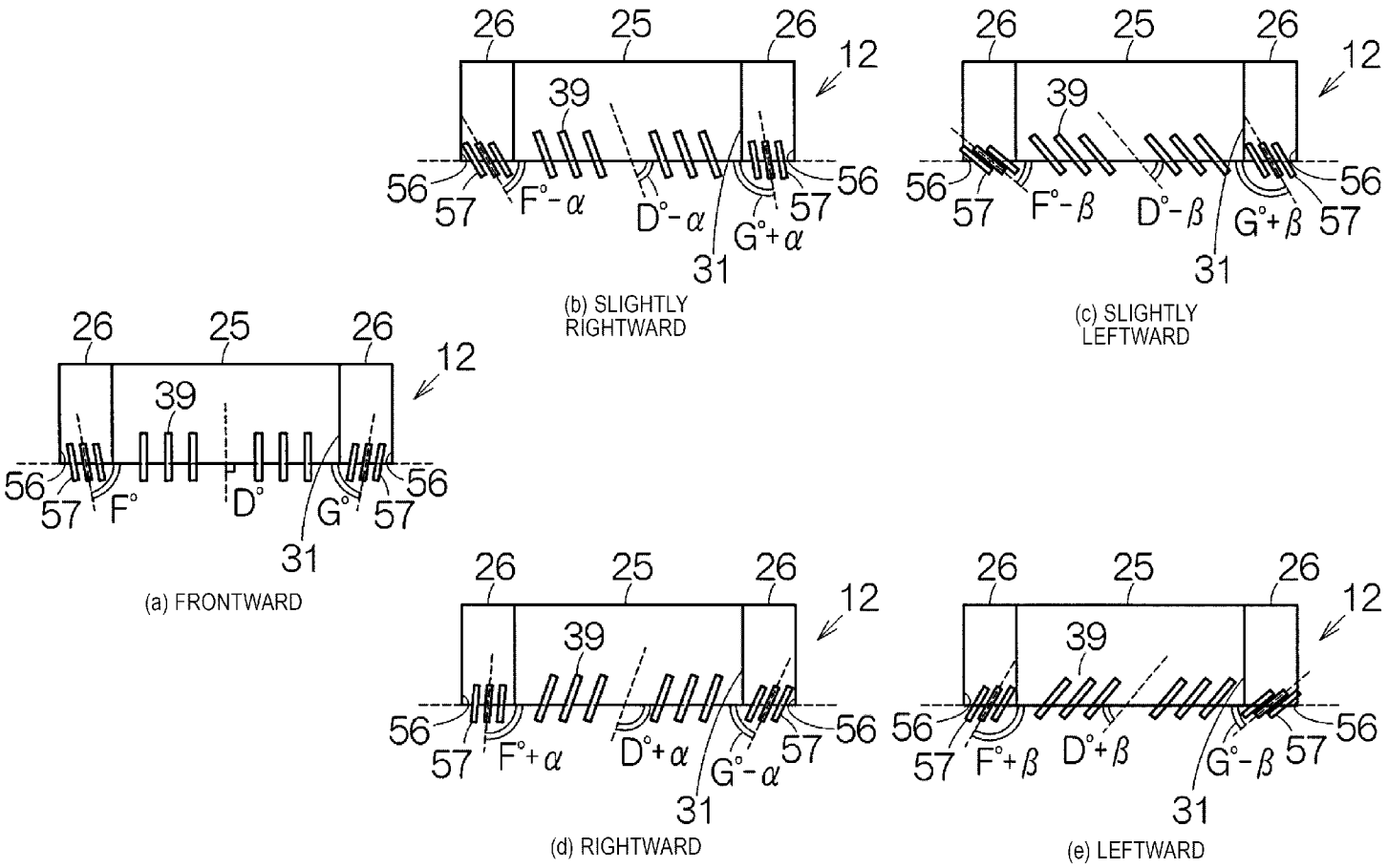
[FIG. 11]

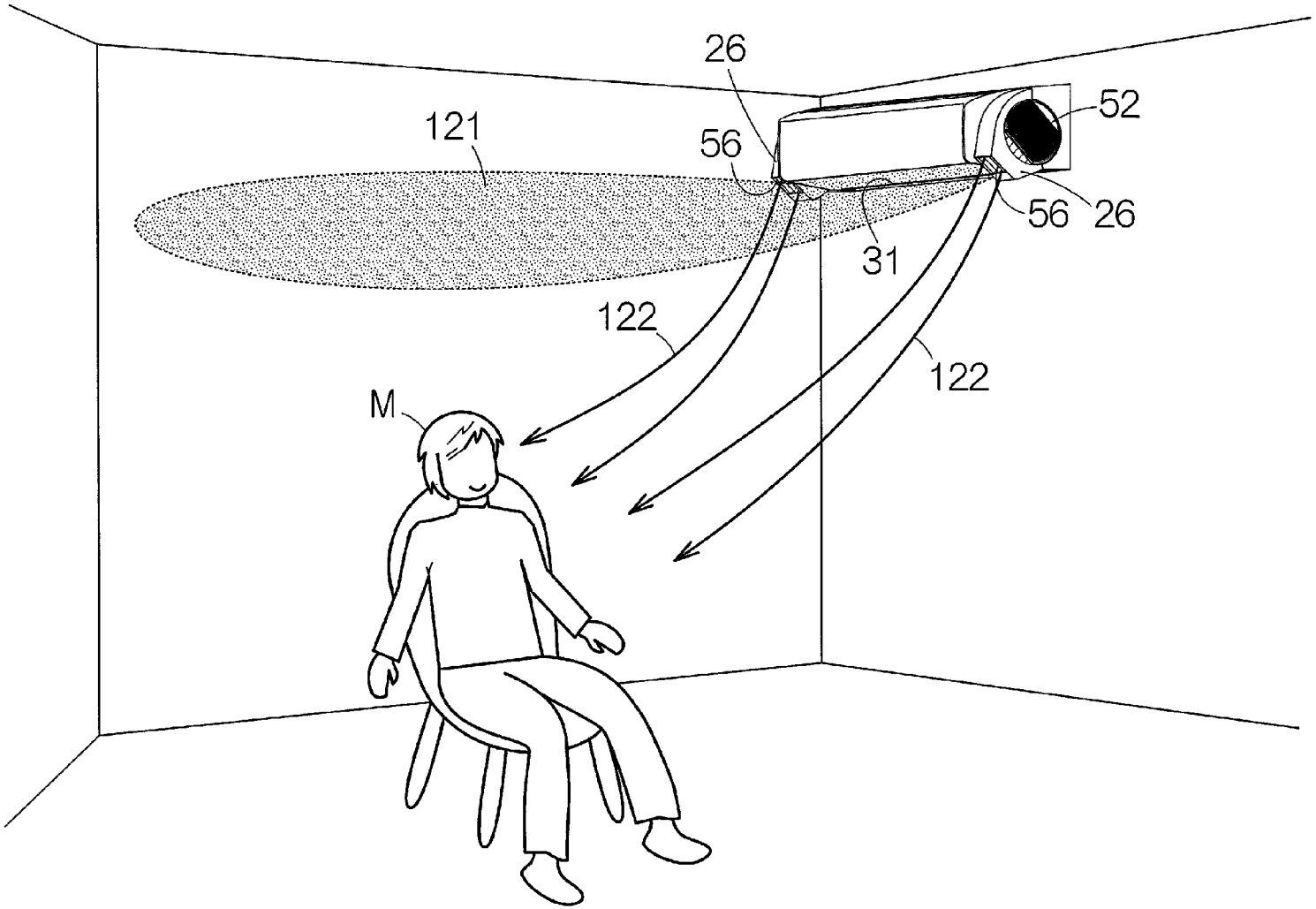
[FIG. 12]

[FIG. 13]
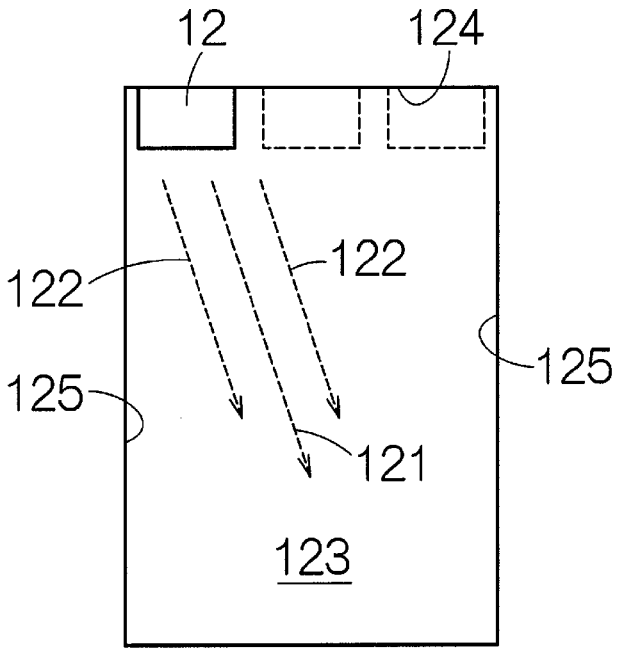
[FIG. 14]
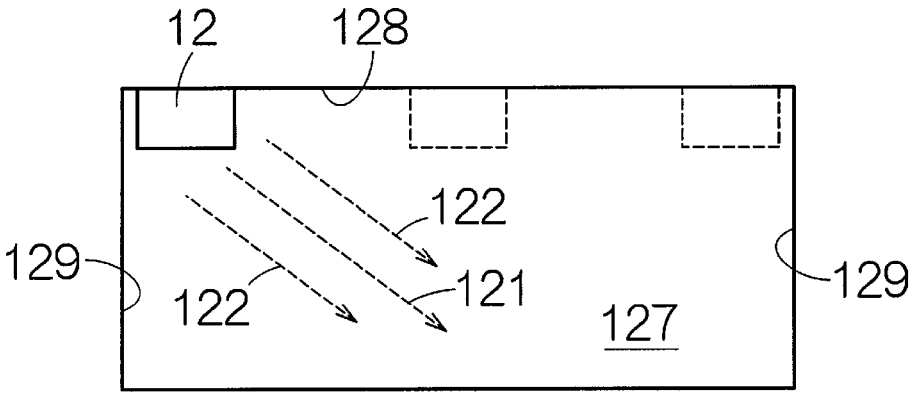

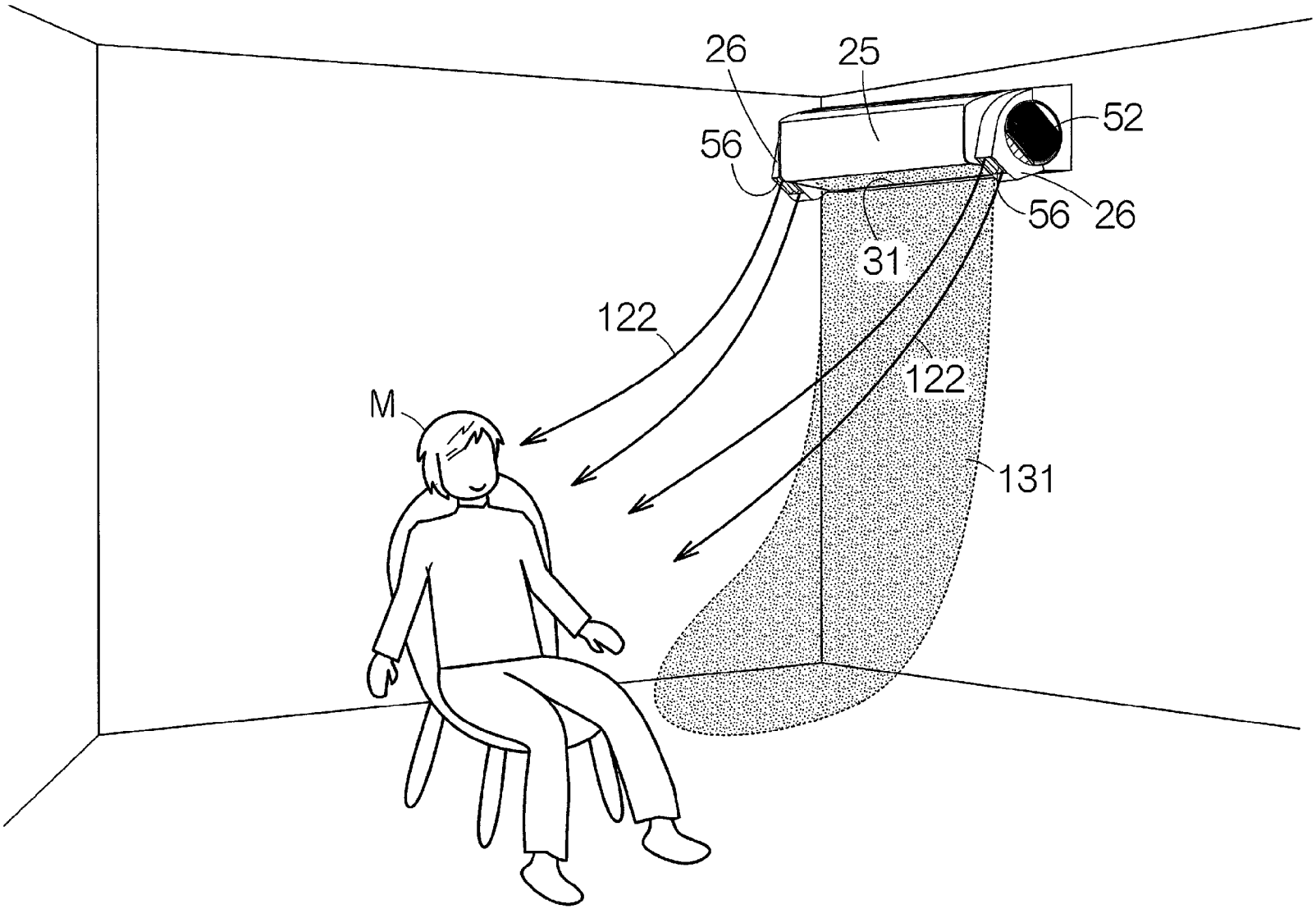
[FIG. 15]

AIR CONDITIONER AND CONTROL CIRCUIT

RELATED APPLICATIONS

This application is a national phase of International Application No. PCT/JP2013/085045, filed on Dec. 27, 2013, which in turn claims the benefit of Japanese Application No. 2012-288432, filed on Dec. 28, 2012, the disclosures of which Applications are incorporated by reference herein.

TECHNICAL FIELD

The present invention relates to an air conditioner and a control circuit for an air conditioner.

BACKGROUND ART

An air conditioner blows out cool air or warm air that is heat-exchanged by a heat exchanger from a first air outlet of an indoor unit. In the description of PTL 1, one pair of second air outlets are disposed to be adjacent to both sides of an air outlet. The second air outlet is open on a front surface of a housing. An airflow which passes through a dust collection filter flows into the first air outlet and the second air outlet. The airflow which passes through the dust collection filter is generated in a centrifugal fan. The centrifugal fan can allow the airflow to sufficiently pass through the dust collection filter having high air resistance. An orientation of the airflow is adjusted by a louver. The louver is attached to the first air outlet and the second air outlet.

CITATION LIST

Patent Literature

PTL 1: JP-A-2010-164271
PTL 2: JP-A-2000-297792

SUMMARY OF INVENTION

Technical Problem

In the description in PTL 1, an airflow which is blown out of a first air outlet and an airflow which is blown out of a second air outlet are deviated in a vertical direction, and a mutual influence thereof is avoided. Therefore, even when the airflow from the second air outlet is blown out at a wind speed which is higher than a wind speed of the airflow from the first air outlet, the airflow of the second air outlet does not influence the airflow of the first air outlet. A concept in which the airflow of the first air outlet is restricted by the airflow from the second air outlet has not been determined.

According to several aspects of the present invention, it is possible to provide an air conditioner which can effectively utilize air blowing from the second air outlet.

Solution to Problem

An aspect of the present invention relates to an air conditioner which is provided with a structural body, an auxiliary housing, and a control circuit. The structural body forms a first air outlet that extends in a horizontal direction when being installed and blows out a cool or warm airflow which is generated by a heat exchanger, and includes a wall body which is fixed to at least one side of the first air outlet. The auxiliary housing is attached to the wall body to be freely movable, and forms a second air outlet which blows out taken-in indoor air. The control circuit blows out the indoor air from the second air outlet at a wind speed which is higher than a wind speed of the cool air or the warm air that is blown out of the first air outlet.

The cool or warm airflow is blown out of the first air outlet of the structural body. The airflow which is blown out of the second air outlet of the auxiliary housing can collide with the cool or warm airflow, and control an orientation or movement of the cool or warm airflow. It is possible to send the cool air or warm air into a desired indoor location. In this manner, it is possible to efficiently regulate an indoor temperature environment. Here, the wind speed of the indoor air is higher than the wind speed of the cool air or the warm air. Therefore, when the airflow of the indoor air is blown out to influence the cool or warm airflow, it is possible to control the cool or warm airflow. The cool air can be sent far, and the warm air can remain close to a floor surface. It is more effective as the wind speed from the second air outlet increases to be higher than the wind speed from the first air outlet.

In the air conditioner, the second air outlet can be opened in an area which is smaller than that of the first air outlet. Therefore, it is possible to form the auxiliary housing to be a small size compared to the structural body. As a result, it is possible to make the entire air conditioner a small size. Even when a volume of air which is blown out of the second air outlet is the constant, the wind speed of the air from an opening which is made to be small can be increased. Therefore, it is not necessary to increase the rotating speed of a blower of the auxiliary housing for increasing the wind speed, and it is possible to reduce noise caused by the blower.

The control circuit can blowout the indoor air from the second air outlet towards an upper space of the warm airflow when a heating operation is performed. The airflow of the indoor air which is blown out of the second air outlet can hold down the ascending warm air from above. The warm air can stay in the vicinity of the floor surface. In this manner, a human being in a room can excellently feel the warm temperature. If the wind speed from the second air outlet is higher than the wind speed from the first air outlet, the indoor airflows along the floor surface, and the human being in the room cannot excellently feel the warm temperature.

The control circuit can change the wind speed of the indoor air by following a change in the wind speed when the wind speed of the warm air is changed when the heating operation is performed, and can maintain the wind speed of the indoor air at a wind speed which is higher than the wind speed of the warm air. In this manner, even when the wind speed of the warm air is changed, the warm air can reliably stay in the vicinity of the floor surface. The human being in the room can adjust the wind speed of the warm air in accordance with the change in the sensible temperature, and as a result, can excellently feel the warm temperature.

Another aspect of the present invention relates to a control circuit for an air conditioner, which is provided with a first blower fan control section and a second blower fan control section. The first blower fan control section controls a first blower fan, and blows out the cool or warm airflow that is generated by a heat exchanger at a first wind speed, from the first air outlet which is formed in the structural body of the indoor unit and extends in the horizontal direction when being installed. The second blower fan control section controls a second blower fan, and blows out the airflow of the indoor air at a second air speed which is higher than the first air speed, from the second air outlet which is formed in the auxiliary housing that is attached to the wall body fixed to the structural body to be freely movable on at least one side of the first air outlet.

The cool or warm airflow is blown out of the first air outlet of the structural body. The airflow which is blown out of the second air outlet of the auxiliary housing can collide with the cool or warm airflow, and control an orientation or movement of the cool or warm airflow. It is possible to send the cool air or warm air into a desired indoor location. In this manner, it is possible to efficiently regulate an indoor temperature environment. Here, the wind speed of the indoor air is higher than the wind speed of the cool air or the warm air. Therefore, even when the airflow of the indoor air collides with the cool or warm airflow, it is possible to avoid dispersion of the cool air or the warm air. The mass of the cool air or the warm air can be maintained.

In addition, still another aspect of the present invention relates to a control program for an air conditioner which is executed in the following step in a calculation processing circuit. The step is as follows: a step of outputting a first driving signal which drives the first blower fan that blows out the cool or warm airflow generated by the heat exchanger at the first wind speed, from the first air outlet which is formed in the structural body of the indoor unit and extends in the horizontal direction when being installed; and a step of outputting a second driving signal which drives the second blower fan that blows out the airflow of the indoor air at the second wind speed which is higher than the first wind speed, from the second air outlet which is formed in the auxiliary housing that is attached to the wall body fixed to the structural body to be freely movable on at least one side of the first air outlet.

Advantageous Effects of Invention

As disclosed above, according to the air conditioner or the like, even when a wind direction of the airflow which is blown out of the first air outlet is changed, air-blowing from the second air outlet can be effectively used.

BRIEF DESCRIPTION OF DRAWINGS

FIG. 1 is a schematic conceptual view illustrating a configuration of an air conditioner according to an embodiment of the present invention.

FIG. 2 is a schematic perspective view illustrating an external appearance of an indoor unit according to the embodiment.

FIG. 3 is a schematic plan view illustrating upper and lower wind direction plates, and left and right wind direction plates of a main body unit.

FIG. 4 is a schematic perspective view illustrating a configuration of a structural body.

FIG. 5 is a schematic perpendicular cross-sectional view of the indoor unit illustrating a configuration of a first blower fan.

FIG. 6 is a schematic perspective view illustrating a structure of a first side panel and a second side panel.

FIG. 7 is an exploded perspective view of a fan unit.

FIG. 8 is a schematic perspective view of a blowing path unit illustrating a rack and a driving gear.

FIG. 9 is a schematic perspective view illustrating a configuration of a driving unit of a wind direction plate.

FIG. 10 is a schematic block diagram illustrating a control system of the air conditioner.

FIG. 11 is a schematic conceptual view illustrating a structure of wind direction reference data.

FIG. 12 is a schematic conceptual view illustrating a specific example of an airflow when a cooling operation is performed.

FIG. 13 is a conceptual view illustrating a wind direction of the airflow which is blown out of a first air outlet and a second air outlet when the indoor unit is installed at a left end of a room toward a wall surface which corresponds to a short side in a longitudinal room.

FIG. 14 is a conceptual view illustrating a wind direction of the airflow which is blown out of the first air outlet and the second air outlet when the indoor unit is installed at a left end of a room toward a wall surface which corresponds to a long side in a lateral room.

FIG. 15 is a conceptual view illustrating a specific example of the airflow when a heating operation is performed.

DESCRIPTION OF EMBODIMENTS

Hereinafter, with reference to the attached drawings, an embodiment of the present invention will be described.

FIG. 1 is a schematic view illustrating a configuration of an air conditioner 11 according to an embodiment of the present invention. The air conditioner 11 is provided with an indoor unit 12 and an indoor unit 13. The indoor unit 12 is installed in an indoor space of a building, for example. Otherwise, the indoor unit 12 may be installed in an environmental space which corresponds to the indoor space. An indoor heat exchanger 14 is embedded in the indoor unit 12. In the indoor unit 13, a compressor 15, an outdoor heat exchanger 16, an expansion valve 17, and a four-way valve 18, are embedded. The indoor heat exchanger 14, the compressor 15, the outdoor heat exchanger 16, the expansion valve 17, and the four-way valve 18 form a refrigerant circuit 19.

The refrigeration circuit 19 is provided with a first circulating path 21. The first circulating path 21 links a first port 18*a* and a second port 18*b* of the four-way valve 18 to each other. In the first circulating path 21, the compressor 15 is provided. An inlet pipe 15*a* of the compressor 15 is connected to the first port 18*a* of the four-way valve 18 via refrigerant piping. A gas refrigerant from the first port 18*a* is supplied to the inlet pipe 15*a* of the compressor 15. The compressor 15 is compressed until pressure of a low-pressure gas refrigerant reaches a predetermined pressure. A discharge pipe 15*b* of the compressor 15 is connected to the second port 18*b* of the four-way valve 18 via the refrigerant piping. The gas refrigerant from the discharge pipe 15*b* of the compressor 15 is supplied to the second port 18*b* of the four-way valve 18. The first circulating path 21 is formed of the refrigerant piping, such as a copper tube.

The refrigerant circuit 19 is further provided with a second circulating path 22. The second circulating path 22 links a third port 18*c* and a fourth port 18*d* of the four-way valve 18 to each other. In the second circulating path 22, the outdoor heat exchanger 16, the expansion valve 17, and the indoor heat exchanger 14 are embedded in order from the third port 18*c* side. The outdoor heat exchanger 16 realizes exchange of heat energy between the passing-through refrigerant and ambient air. The indoor heat exchanger 14 realizes exchange of heat energy between the passing-through refrigerant and the ambient air. The second circulating path 22 may be formed of the refrigerant piping, such as a copper tube.

A blower fan 23 is embedded in the indoor unit 13. The blower fan 23 ventilates for the outdoor heat exchanger 16. The blower fan 23 generates an airflow in accordance with rotation of an impeller, for example. The airflow goes through the outdoor heat exchanger 16. Flux of the going-through airflow is adjusted in accordance with a rotating speed per minute of the impeller. In the outdoor heat exchanger 16, an amount of heat energy which is exchanged between a refrigerant and the air is adjusted in accordance with the flux of the airflow.

The indoor unit 12 is provided with a main body unit 25 and one pair of fan units 26. The indoor heat exchanger 14 and a first blower fan 27 are embedded in the main body unit 25. The first blower fan 27 is ventilated in the indoor heat exchanger 14. The first blower fan 27 generates the airflow in accordance with the rotation of the impeller. The indoor air is sucked in the main body unit 25 by the action of the first blower fan 27. The indoor air exchanges heat with the refrigerant which goes through the indoor heat exchanger 14. The heat-exchanged cool or warm airflow is blown out of the main body unit 25. Flux of the going-through airflow is adjusted in accordance with a rotating speed per minute of the impeller. It is possible to adjust an amount of heat energy which is exchanged between the refrigerant and the air by the indoor heat exchanger 14 in accordance with the flux of the airflow. The fan unit 26 sucks in the indoor air and blows out the indoor air. The indoor air is blown out by the fan unit 26 without being heat-exchanged.

When the cooling operation is performed by the refrigerant circuit 19, the four-way valve 18 connects the second port 18*b* and the third port 18*c* to each other, and connects the first port 18*a* and the fourth port 18*d* to each other. Therefore, the refrigerant having a high temperature and high pressure is supplied to the outdoor heat exchanger 16 from the discharge pipe 15*b* of the compressor 15. The refrigerant flows through the outdoor heat exchanger 16, the expansion valve 17, and the indoor heat exchanger 14 in order. Heat is radiated to outdoor air from the refrigerant by the outdoor heat exchanger 16. The pressure of the refrigerant is reduced until the pressure becomes low pressure by the expansion valve 17. The refrigerant of which the pressure is reduced absorbs heat from the ambient air by the indoor heat exchanger 14. Cool air is generated. The cool air flows in the indoor space in accordance with the action of the first blower fan 27.

When the heating operation is performed by the refrigerant circuit 19, the four-way valve 18 connects the second port 18*b* and the fourth port 18*d* to each other, and connects the first port 18*a* and the third port 18*c* to each other. The refrigerant having a high temperature and high pressure is supplied to the indoor heat exchanger 14 from the compressor 15. The refrigerant flows through the indoor heat exchanger 14, the expansion valve 17, and the outdoor heat exchanger 16 in order. Heat is radiated to the ambient air from the refrigerant by the indoor heat exchanger 14. Warm air is generated. The warm air flows in the indoor space in accordance with the action of the first blower fan 27. The pressure of the refrigerant is reduced until the pressure becomes low pressure by the expansion valve 17. The refrigerant of which the pressure is reduced absorbs the heat from the ambient air by the outdoor heat exchanger 16. After this, the refrigerant returns to the compressor 15.

FIG. 2 is a schematic view illustrating an external appearance of the indoor unit 12 according to the embodiment. The main body unit 25 of the indoor unit 12 is provided with a structural body 28. The structural body 28 is covered with an outer panel 29. A first air outlet 31 is formed on a lower surface of the structural body 28. The first air outlet 31 is open downward. The structural body 28 can be fixed to an indoor wall surface, for example. The first air outlet 31 is provided to extend in an orientation which is a horizontal direction when being installed, and the cool or warm airflow which is generated by the indoor heat exchanger 14 is blown out.

One pair of upper and lower wind direction plates 32*a* and 32*b* are disposed at a front and back part in the first air outlet 31. The upper and lower wind direction plates 32*a* and 32*b* can respectively rotate around horizontal shaft lines 33*a* and 33*b*. In the embodiment, a back end of the upper and lower wind direction plates 32*a* and 32*b* functions as a rotation shaft, but the invention is not limited thereto. The upper and lower wind direction plates 32*a* and 32*b* can open and close the first air outlet 31 in accordance with the rotation.

As illustrated in FIG. 3, left and right protruding shafts 34*a* and 34*b* are formed coaxially with the horizontal shaft lines 33*a* and 33*b* on the upper and lower wind direction plates 32*a* and 32*b*. The protruding shafts 34*a* and 34*b* protrude to the outside of an outline of the first air outlet 31 from the left and right of the upper and lower wind direction plates 32*a* and 32*b*. The protruding shafts 34*a* and 34*b* are linked to the structural body 28 to be freely rotatable around the horizontal shaft lines 33*a* and 33*b*. When the protruding shafts 34*a* and 34*b* are linked to the structural body 28, the protruding shafts 34*a* and 34*b* may be received by a bearing which is integrated with the structural body 28, for example.

An upper and lower wind direction plates driving source 36 is connected to the protruding shafts 34*a* and 34*b*. The upper and lower wind direction plates driving source 36 is configured of an electric motor, for example. When the upper and lower wind direction plates driving source 36 is connected to the protruding shafts 34*a* and 34*b*, follower gears 37 are attached to the protruding shafts 34*a* and 34*b*, for example. Similarly, a driving gear 38 is attached to a drive shaft of the electric motor. The driving gear 38 meshes with the follower gears 37. In this manner, the rotation of the electric motor is transferred to the protruding shafts 34*a* and 34*b* at a predetermined transfer ratio. The rotation of the upper and lower wind direction plates 32*a* and 32*b* is caused in accordance with the operation of the upper and lower wind direction plates driving source 36.

A plurality of left and right wind direction plates 39 are disposed in the first air outlet 31. The left and right wind direction plates 39 are aligned, for example, at an equivalent interval in the horizontal direction along the horizontal shaft lines 33*a* and 33*b*. Each left and right wind direction plates 39 can rotate around a rotation shaft line 41. The rotation shaft line 41 extends within a plane which is orthogonal to the horizontal shaft lines 33*a* and 33*b*. All of the rotation shaft lines 41 are included in one imaginary plane which widens in parallel to the horizontal shaft lines 33*a* and 33*b*. It is desirable that the imaginary plane is orthogonal to an airflow passage which leads to the first air outlet 31.

In the left and right wind direction plates 39, a protruding shaft 42 is formed coaxially with the rotation shaft line 41. The protruding shaft 42 protrudes from above and below (or any one of these) the left and right wind direction plates 39, for example. The protruding shaft 42 is linked to the structural body 28 to be freely rotatable around the rotation shaft line 41. When the protruding shaft 42 is linked to the structural body 28, the protruding shaft 42 may be received by a bearing member which is fixed to the structural body 28, for example.

A left and right wind direction plates driving source 43 which functions as first wind direction plate control means is connected to the protruding shaft 42. The left and right wind direction plates driving source 43 can be configured of the electric motor, for example. When the left and right wind direction plates driving source 43 is connected to the protruding shaft 42, a linking shaft 44 is formed in each of the left and right wind direction plates 39, for example. The linking shaft 44 extends in parallel to the rotation shaft line 41 at a position which is deviated from the rotation shaft line 41. A rack member 45 is linked to the linking shaft 44 to be freely rotatable around a shaft center of the linking shaft 44. A driving gear 46 is attached to a driving shaft of the electric motor. The driving gear 46 meshes with a gear 47 of the rack member 45. In this manner, the rotation of the electric motor is converted to a straight-line motion of the rack member 45. The rack member 45 causes fluctuation of the linking shaft 44 around the rotation shaft line 41. In this manner, the rotation of the left and right wind direction plates 39 is caused.

As illustrated in FIG. 4, a first suction port 48 is formed in the structural body 28. The first suction port 48 is open on a front surface and an upper surface of the structural body 28. The outer panel 29 can cover the first suction port 48 on the front surface of the structural body 28. The first suction port 48 extends in the horizontal direction when being installed, and takes in the indoor air which flows into the indoor heat exchanger 14.

The fan units 26 are separately attached to both end sections of a main body which become outer wall surfaces of the structural body 28 on both sides of the first suction port 48 that extends in the horizontal direction and the first air outlet 31. The fan unit 26 is disposed on the outside of the outer wall surface of the structural body 28. The fan units 26 are respectively provided with fan housings 49. The fan housing 49 is supported on the outer wall surface of the structural body 28 to be freely movable with respect to the structural body 28. Here, the fan housing 49 can rotate around the rotation shaft which intersects the outer wall surface of the structural body 28. In the embodiment, the rotation shaft of the fan housing 49 overlaps with a horizontal shaft line 51. The horizontal shaft lines 33*a*, 33*b*, and 51 extend in parallel to each other. The outer wall surfaces of the structural body 28 widen in parallel to each other. Therefore, the outer wall surfaces provided on both end sections of the structural body 28 are orthogonal to the horizontal shaft lines 33*a*, 33*b*, and 51.

In the fan housing 49, a second suction port 52 is formed. The second suction port 52 takes in the indoor air from a perpendicular direction of the outer wall surface of the structural body 28. The second suction port 52 is covered with a suction port cover 53. The suction port cover 53 is attached to the fan housing 49. An outline of the suction port cover 53 is partitioned along an imaginary cylindrical surface 54 on an inner side of the imaginary cylindrical surface 54 coaxially with the horizontal shaft line 51. In other words, the suction port cover 53 has a circular outline. In the suction port cover 53, a plurality of openings 55 are formed. The openings 55 connect outer and inner spaces of the second suction port 52 to each other.

In the fan housing 49, a second air outlet 56 is formed. The second air outlet 56 blows out the indoor air which is taken in the fan housing 49 from the second suction port 52. The airflow from the second air outlet 56 is blown out in a direction which is along the outer wall surface. When the fan housing 49 rotationally moves around the horizontal shaft line 51, the second air outlet 56 can be vertically displaced in a direction of gravity. The orientation of the airflow which is blown out of the second air outlet 56 can be changed. Here, a forward direction side which follows an orientation of the rotation of the fan housing 49 that makes the second air outlet 56 descend in the direction of gravity is referred to as "downstream", and a reverse direction side is referred to as "upstream". A wind direction plate 57 (hereinafter, referred to as a "fan unit wind direction plate 57") is attached to the second air outlet 56. The fan unit wind direction plate 57 can make the orientation of the airflow which is blown out of the second air outlet 56 deflect in the horizontal direction. A total opening area of the two second air outlets 56 may be smaller than an opening area of the first air outlet 31.

In addition, a structure in which a posture of the fan housing 49 is changed is not limited thereto. For example, a wind direction plate which changes the wind direction in the vertical direction may be provided in the second air outlet 56, the fan housing 49 may be supported to be freely fluctuated on a rear surface side of the fan housing 49 on the outer wall surface of the structural body 28, and the orientation of the second air outlet 56 may be changed in the horizontal direction. In addition, a wind direction plate which changes the wind direction in the horizontal direction may be provided in the second air outlet 56, and the fan housing 49 may be vertically moved by a guide rail provided on the outer wall surface of the structural body 28.

The structural body 28 is provided with an auxiliary structural body 58. The auxiliary structural body 58 is formed on the outer wall surface on the periphery of the fan housing 49. The auxiliary structural body 58 protrudes further outside than the fan housing 49 from the outer wall surface. An edge of the auxiliary structural body 58 is divided along the suction port cover 53 on the outer side of the above-described imaginary cylindrical surface 54.

As illustrated in FIG. 5, in the structural body 28, the first blower fan 27 is supported to be freely rotatable. As the first blower fan 27, a cross flow fan can be used, for example. The first blower fan 27 can rotate around a rotation shaft 61 which is parallel to the horizontal shaft line 51. The rotation shaft 61 of the first blower fan 27 extends in the horizontal direction when being installed. In this manner, the first blower fan 27 is disposed in parallel to the first air outlet 31. On the periphery of the first blower fan 27, the indoor heat exchanger 14 is disposed.

A first blower fan driving source 62 is fixed to the structural body 28. As the first blower fan driving source 62, the electric motor can be used, for example. A driving shaft of the first blower fan driving source 62 rotates around a shaft center thereof. The driving shaft can be disposed coaxially with the rotation shaft 61 of the first blower fan 27. The driving shaft of the first blower fan driving source 62 can be combined with a rotation shaft of the first blower fan 27. In this manner, a driving force of the first blower fan driving source 62 is transferred to the first blower fan 27. The first blower fan driving source 62 drives the first blower fan 27. The airflow passes through the indoor heat exchanger 14 in accordance with the rotation of the first blower fan 27. As a result, the cool or warm airflow is generated. The cool or warm airflow is blown out of the first air outlet 31.

As illustrated in FIG. 6, the structural body 28 is provided with a first side panel 64*a* and a second side panel 64*b* together with a main housing 63*a* and a front panel 63*b*. The first air outlet 31 is formed in the main housing 63*a*. On both sides of the first air outlet 31, the first side panel 64*a* and the second side panel 64*b* are attached to the main housing 63*a*. The first side panel 64*a* and the second side panel 64*b* constitute an outer shell of the structural body 28. The first side panel 64*a* and the second side panel 64*b* respectively have wall bodies 65. Each of the wall bodies 65 is provided to be parallel to each other on both sides of the main housing 63*a*. An outer wall surface 65*a* of the wall body 65 corresponds to the outer wall surface of the structural body 28. Here, the outer wall surface 65*a* may be orthogonal to the horizontal shaft line 51. The wall body 65 is fixed to be immovable with respect to the first air outlet 31 on both sides of the first air outlet 31. The auxiliary structure bodies 58 are respectively integrated with the first side panel 64*a* and the second side panel 64*b*. The member which is made in this manner can be formed based on integral molding from a hard resin material. Similarly, the second side panel 64*b* and the auxiliary structural body 58 can constitute one member. In the embodiment, the first side panel 64*a* and the auxiliary structural body 58, or the second side panel 64*b* and the auxiliary structural body 58, constitute one member, but these may be configured of separate members.

When the first side panel 64*a* and the second side panel 64*b* are attached to the structural body 28, a screw 66 is used. The screw 66 penetrates the first side panel 64*a* and the second side panel 64*b*, and is screwed to the main housing 63*a*. When the screw 66 is screwed, a shaft center of the screw 66 is orthogonal to an imaginary plane 67. The imaginary plane 67 is oriented to the front surface of the structural body 28. Here, the imaginary plane 67 is parallel to the horizontal shaft line 51, and is parallel to the indoor wall surface when the indoor unit 12 is installed. Therefore, the imaginary planes 67 are positioned on the front surface sides of the first side panel 64*a* and the second side panel 64*b*. The main housing 63*a* has a boss 68 for a screw. A screw hole is formed in the boss 68. The screw hole faces the imaginary plane 67. A screw insertion piece 69 is attached to the first side panel 64*a* and the second side panel 64*b*. The screw insertion piece 69 overlaps with one surface of the boss 68. The screw 66 penetrates the screw insertion piece 69 and is screwed to the boss 68.

As illustrated in FIG. 7, each fan unit 26 is provided with a first decorative housing 71*a* and a second decorative housing 71*b*. The fan housing 49 is configured of the first decorative housing 71*a* and the second decorative housing 71*b*. As the first decorative housing 71*a* and the second decorative housing 71*b* are combined with each other, the second air outlet 56 is formed. The second suction port 52 is partitioned in the first decorative housing 71*a*. In an inner space which is partitioned by the first decorative housing 71*a* and the second decorative housing 71*b*, a blowing path unit 72, a centrifugal fan 73 which functions as the second blower fan, an attaching board 74, a second blower fan driving source 75, and a protection member 76 are accommodated.

The fan unit 26 is provided with the blowing path unit 72. The blowing path unit 72 is configured of a first member 72*a* and a second member 72*b*. The first member 72*a* of the blowing path unit 72 is combined with the second decorative housing 71*b*. In this manner, the blowing path unit 72 is integrated to the fan housing 49. A cylindrical section 77 is formed in the first member 72*a* of the blowing path unit 72. The cylindrical section 77 forms a cylindrical surface 77*a* coaxially with the horizontal shaft line 51 on an inner surface thereof. The blowing path unit 72 forms an opening 78 through the second suction port 52, and a blowing path 79 which extends to the second air outlet 56.

The fan unit 26 is provided with the centrifugal fan 73. The centrifugal fan 73 is accommodated in the blowing path unit 72. As the centrifugal fan 73, a sirocco fan can be used, for example. A rotation shaft of the centrifugal fan 73 intersects the outer wall surface 65*a* of the wall body 65. Here, the rotation shaft of the centrifugal fan 73 intersects the outer wall surface 65*a*. The rotation shaft of the centrifugal fan 73 can overlap with the horizontal shaft line 51. When the centrifugal fan 73 rotates, the indoor air is taken from the opening 78 along the rotation shaft of the centrifugal fan 73. The centrifugal fan 73 pushes out the indoor air in a centrifugal direction across the entire periphery. The indoor air which is pushed out in this manner is blown out of the second air outlet 56 across the blowing path 79.

The fan unit 26 is provided with the attaching board 74. As will be described later, the attaching board 74 is linked to the first member 72*a* of the blowing path unit 72. An external appearance of the fan unit 26 is configured of the first decorative housing 71*a*, the second decorative housing 71*b*, and the attaching board 74. The attaching board 74 overlaps with the outer wall surface 65*a* of the wall body 65. The attaching board 74 is screwed to the wall body 65. A screw 81 penetrates the wall body 65 from the inner wall surface (rear side of the outer wall surface) of the wall body 65 and is screwed to the attaching board 74. Each screw 81 can have a shaft center which is parallel to the horizontal shaft line 51. In this manner, the fan units 26 are respectively fixed to the first side panel 64*a* and the second side panel 64*b*.

The fan unit 26 is provided with the second blower fan driving source 75. The second blower fan driving source 75 is supported by the attaching board 74. The attaching board 74 overlaps with the outer wall surface 65*a* of the wall body 65. Therefore, the second blower fan driving source 75 is fixed to the outer wall surface 65*a* of the wall body 65 on both sides of the first air outlet 31. The second blower fan driving source 75 can be configured of the electric motor, for example. The centrifugal fan 73 is fixed to a driving shaft 82 of the second blower fan driving source 75.

The fan unit 26 is provided with the protection member 76. The protection member 76 is fixed to the attaching board 74. The protection member 76 can be formed in a shape of a so-called dome. The protection member 76 is covered with the second blower fan driving source 75. The driving shaft 82 of the second blower fan driving source 75 penetrates the protection member 76, and protrudes to a side to which the centrifugal fan 73 of the protection member 76 is attached from a side to which the second blower fan driving source 75 is attached. The centrifugal fan 73 is mounted on the driving shaft 82 of the second blower fan driving source 75 on the outer side of the protection member 76. The protection member 76 blocks an opening of the cylindrical section 77.

The fan unit 26 is provided with a plurality of rollers 83. The rollers 83 are disposed at an equivalent distance from the horizontal shaft line 51. The roller 83 has a columnar body. The columnar body is supported by the protection member 76 to be freely rotatable. A shaft center of the columnar body extends in parallel to the horizontal shaft line 51. The roller 83 can rotate around the shaft center of the columnar body. The columnar body can be formed of a resin material, such as a polyacetal resin (POM). The columnar body is in contact with the cylindrical surface 77*a* of the blowing path unit 72 on the inner side thereof. In this manner, the blowing path unit 72 is linked to the protection member 76 to be freely rotatable around the horizontal shaft line 51 via a group of rollers 83.

As illustrated in FIG. 8, a rack 84 is formed in the cylindrical section 77 of the blowing path unit 72. The rack 84 is disposed on the cylindrical surface 77*a* at a position which is deviated from the roller 83 in a direction along the horizontal shaft line 51, and extends concentrically to the horizontal shaft line 51. A driving gear 85 meshes with the rack 84. A rotation shaft of the driving gear 85 is set to be parallel to the horizontal shaft line 51. The cylindrical section 77 can rotate with respect to the protection member 76 around the horizontal shaft line 51 in accordance with the rotation of the driving gear 85. In other words, the blowing path unit 72 can rotate.

An enclosure driving source 86 is attached to the attaching board 74. The enclosure driving source 86 can be configured of the electric motor, for example. The driving shaft of the enclosure driving source 86 is linked to the driving gear 85. A shaft center of the driving shaft overlaps with the rotation shaft of the driving gear 85. In this manner, the rotation of the driving gear 85 is caused based on power of the enclosure driving source 86. The enclosure driving source 86 generates a driving force which causes the rotation of the fan housing 49.

As illustrated in FIG. 9, the fan unit 26 is provided with a driving unit 87 of the fan unit wind direction plate 57. The fan unit wind direction plate 57 can change a posture around a rotation shaft 88 which is fixed to the first member 72*a* of the blowing path unit 72. The rotation shaft 88 is in the imaginary plane which is orthogonal to the horizontal shaft line 51, and overlaps with a tangential line which is in contact with an imaginary circle concentrically to the horizontal shaft line 51. A driving unit 87 is fixed to the blowing path unit 72 on an upper side of the blowing path 79 which is accommodated in the fan housing 49.

The driving unit 87 is provided with a link member 89. The link member 89 is linked to the fan unit wind direction plate 57. When the link member 89 is linked to the fan unit wind direction plate 57, a link case 91 is fixed to the blowing path unit 72. The link case 91 holds an upper end of the fan unit wind direction plate 57 to be freely rotatable around the rotation shaft 88 of the fan unit wind direction plate 57. An eccentric shaft 92, which is eccentric from the rotation shaft 88 of the fan unit wind direction plate 57 and extends in parallel to the rotation shaft 88 of the fan unit wind direction plate 57, is connected to the upper end of the fan unit wind direction plate 57. In the link case 91, a guide path 93 of the eccentric shaft 92 is formed. The guide path 93 of the eccentric shaft 92 guides the movement of the eccentric shaft 92 along an arc which is concentric to the rotation shaft 88 of the fan unit wind direction plate 57 when the fan unit wind direction plate 57 rotates.

The driving unit 87 is provided with a left and right wind direction plates driving source 94 which functions as second wind direction control means. The left and right wind direction plates driving source 94 can be configured of the electric motor, for example. The left and right wind direction plates driving source 94 is fixed to the blowing path unit 72. The left and right wind direction plates driving source 94 has a driving shaft 94*a* which extends in parallel to the rotation shaft 88 of the fan unit wind direction plate 57. An upper end of the driving shaft 94*a* is held by the link case 91 to be freely rotatable. An eccentric shaft 96, which is eccentric from a shaft center 95 of the driving shaft 94*a* and extends in parallel to the shaft center 95 of the driving shaft 94*a*, is connected to the upper end of the driving shaft 94*a*. In the link case 91, a guide path 97 of the eccentric shaft 96 is formed. The guide path 97 of the eccentric shaft 96 guides the movement of the eccentric shaft 96 along an arc which is concentric to the shaft center 95 of the driving shaft 94*a*.

The link member 89 holds the eccentric shafts 92 and 96 to be freely rotatable. When the eccentric shaft 96 moves on the guide path 97 in accordance with the rotation of the left and right wind direction plates driving source 94, the movement of the eccentric shaft 96 causes the movement of the link member 89. When the link member 89 moves, the link member 89 maintains a posture thereof. The movement of the eccentric shaft 96 generates the movement of the eccentric shaft 92 along the same path as that of the movement of the eccentric shaft 96. In this manner, a posture of the fan unit wind direction plate 57 can be changed synchronously. The driving unit 87 generates a driving force which causes a change in the posture of the fan unit wind direction plate 57.

FIG. 10 is a schematic diagram illustrating a control system of the air conditioner 11. A control unit 101 which functions as a control circuit that performs control of the air conditioner 11 is provided with a cooling/heating establishment section 102. The cooling/heating establishment section 102 controls the operation of the refrigerant circuit 19. In accordance with the control of the cooling/heating establishment section 102, the cooling operation or heating operation are selectively established by the refrigerant circuit 19. The indoor unit 13 is connected to the cooling/heating establishment section 102. The cooling/heating establishment section 102 controls the movement of the compressor 15, the expansion valve 17, and the four-way valve 18. When this control is performed, the cooling/heating establishment section 102 supplies a control signal to the compressor 15, the expansion valve 17, and the four-way valve 18. For example, a position of a valve is switched by the action of the control signal by the four-way valve 18.

The control unit 101 is provided with a main body unit control block 103. The main body unit control block 103 controls an operation of the main body unit 25. The main body unit control block 103 includes a first blower fan control section 104, an upper and lower wind direction plates control section 105, and a left and right wind direction plates control section 106. The first blower fan driving source 62 is electrically connected to the first blower fan control section 104. The first blower fan control section 104 controls an operation of the first blower fan driving source 62. When this control is performed, the first blower fan control section 104 supplies a first driving signal to the first blower fan driving source 62. In accordance with the supply of the first driving signal, the first blower fan driving source 62 starts or stops the first blower fan 27, and controls the rotating speed per minute. The upper and lower wind direction plates driving source 36 of the main body unit 25 is electrically connected to the upper and lower wind direction plates control section 105. The upper and lower wind direction plates control section 105 controls an operation of the upper and lower wind direction plates driving source 36. When this control is performed, the upper and lower wind direction plates control section 105 supplies the control signal to the upper and lower wind direction plates driving source 36. In accordance with the supply of the control signal, the upper and lower wind direction plates driving source 36 realizes the control of the orientations of the upper and lower wind direction plates 32*a* and 32*b*. The left and right wind direction plates driving source 43 is electrically connected to the left and right wind direction plates control section (first wind direction control section) 106. The left and right wind direction plates control section 106 controls an operation of the left and right wind direction plates driving source 43. When this control is performed, the left and right wind direction plates control section 106 supplies a first wind direction control signal to the left and right wind direction plates driving source 43. In accordance with the supply of the first wind direction control signal, the left and right wind direction plates driving source 43 realizes the control of the orientation of the left and right wind direction plates 39.

Here, the first blower fan control section 104 switches an air volume of the first blower fan 27 in five stages, including "super strong", "strong", "weak", "very weak", and "quiet". The air volume of the "strong" is set to be smaller than the air volume of the "super strong". The air volume of the "weak" is set to be smaller than the air volume of the "strong". Air volume of the "very weak" is set to be further smaller than the air volume of the "weak". The air volume of the "quiet" is set to be even smaller than the air volume of the "very weak". The air volume is designated by the first driving signal. In accordance with the air volume, the rotating speed per minute of the first blower fan 27 is specified by the first driving signal. For example, when the "super strong" is set, a first rotating speed is designated. When the "strong" is set, a second rotating speed which is lower than the first rotating speed is designated. When the "weak" is set, a third rotating speed which is lower than the second rotating speed is designated. When the "very weak" is set, a fourth rotating speed which is lower than the third rotating speed is designated. When the "quiet" is set, a fifth rotating speed which is lower than the fourth rotating speed is set. The first blower fan 27 rotates at a rotating speed which is specified by the first driving signal.

In addition, in a case of the same blower, there is relevance that, when the air volume of the blower fan increases, the wind speed becomes higher, and when the air volume decreases, the wind speed becomes lower. Therefore, in the embodiment, the air volume will be used in the description. In addition, a predetermined effect may be obtained by making the wind speed of the airflow by the first blower fan 27 and the wind speed of the airflow by the fan unit 26 different from each other. Accordingly, at least a maximum wind speed in the fan unit 26 may be set to be higher than a minimum wind speed in the first blower fan 27. It is not necessary to make the wind speed of the first blower fan 27 higher than all of the rotating speeds of the fan unit 26.

The control unit 101 is provided with a fan unit control block 107. The fan unit control block 107 controls an operation of the fan unit 26. The fan unit control block 107 includes a second blower fan control section 108, a housing posture control section 109, and a left and right wind direction plates control section 111. The second blower fan driving sources 75 are respectively electrically connected to the second blower fan control section 108. The second blower fan control section 108 individually controls operations of the two second blower fan driving sources 75. When this control is performed, the second blower fan control section 108 supplies the second driving signal to the second blower fan driving source 75. In accordance with the supply of the second driving signal, the second blower fan driving source 75 starts or stops the centrifugal fan 73, and controls the rotating speed per minute. When the second driving signal is generated, the second blower fan control section 108 refers to the first driving signal. The rotating speed per minute of the centrifugal fan 73 can be set in accordance with the rotating speed per minute which is regulated by the first driving signal. The enclosure driving sources 86 of the fan unit 26 are respectively electrically connected to the housing posture control section 109. The housing posture control section 109 controls an operation of the enclosure driving source 86. When this control is performed, the housing posture control section 109 individually supplies a third driving signal to the enclosure driving source 86. In accordance with the supply of the third driving signal, the enclosure driving source 86 realizes the control of the orientation of the fan housing 49. When the third driving signal is generated, the housing posture control section 109 refers to the control signal of the upper and lower wind direction plates control section 105. In accordance with a posture which is regulated by the control signal of the upper and lower wind direction plates control section 105, the posture of the fan housing 49 can be determined. The left and right wind direction plate driving sources 94 are respectively electrically connected to the left and right wind direction plates control section 111. The left and right wind direction plates control section 111 controls an operation of the left and right wind direction plates driving source 94. When this control is performed, the left and right wind direction plates control section 111 supplies a second wind direction control signal to the left and right wind direction plates driving source 94. In accordance with the supply of the second wind direction control signal, the left and right wind direction plates driving source 94 realizes the control of the orientation of the fan unit wind direction plate 57. When the second wind direction control signal is generated, the left and right wind direction plates control section 111 refers to the first wind direction control signal. In accordance with a posture which is regulated by the first wind direction control signal, the posture of the fan unit wind direction plate 57 can be determined.

Here, the second blower fan control section 108 switches an air volume of the centrifugal fan 73 in five stages, including "super strong", "strong", "weak", "very weak", and "quiet". The air volume of the "strong" is set to be smaller than the air volume of the "super strong". The air volume of the "weak" is set to be smaller than the air volume of the "strong". Air volume of the "very weak" is set to be further smaller than the air volume of the "weak". The air volume of the "quiet" is set to be even smaller than the air volume of the "very weak". Moreover, the total air volume of the "super strong" of two centrifugal fans 73 is set to be smaller than the air volume of the "super-strong" of the first blast fan 27. The total air volume of the "strong" of the two centrifugal fans 73 is set to be smaller than the air volume of the "strong" of the first blast fan 27. The total air volume of the "weak" of the two centrifugal fans 73 is set to be smaller than the air volume of the "weak" of the first blast fan 27. The total air volume of "very weak" of the two centrifugal fans 73 is set to be smaller than the air volume of the "very weak" of the first blast fan 27. The total air volume of the "quiet" of the two centrifugal fans 73 is set to be smaller than the air volume of the "quiet" of the first blower fan 27. The air volume is designated by the second driving signal. The rotating speed per minute of the centrifugal fan 73 is specified in accordance with the air volume by the second drive signal. For example, when the "super strong" is set, a sixth rotating speed is designated. When the "strong" is set, a seventh rotating speed which is lower than the sixth rotating speed is designated. When the "weak" is set, an eighth rotating speed which is lower than the seventh rotating speed is designated. When the "very weak" is set, a ninth rotating speed which is lower than the eighth rotating speed is designated. When the "very weak" is set, a tenth rotating speed which is lower than the ninth rotating speed is designated. The centrifugal fan 73 rotates at a rotating speed which is specified by the second driving signal.

A light receiving element 113 is connected to the control unit 101, for example. A command signal is wirelessly supplied to the light receiving element 113 from a remote control unit, for example. The command signal specifies an operation mode or a set room temperature of the air conditioner 11, for example. The operation mode or the set room temperature is described in the command signal in accordance with the operation of the remote control unit. Examples of the operation mode include a "cooling operation", a "heating operation", a "dehumidifying operation", and an "air-blowing operation". The light receiving element 113 outputs the received command signal. The command signals are respectively supplied to the cooling/heating establishment section 102, the main body unit control block 103, and the fan unit control block 107. The cooling/heating establishment section 102, the main body unit control block 103, and the fan unit control block 107 operate in accordance with the operating mode or the set room temperature which is specified by the command signal.

A room temperature sensor 114 is connected to the control unit 101. The room temperature sensor 114 is attached to the windward side of the indoor heat exchanger 14 in the indoor unit 12, for example. The room temperature sensor 114 detects the temperature on the periphery of the indoor unit 12. The room temperature sensor 114 outputs a temperature signal in accordance with the detection result. The room temperature is specified by the temperature signal. The temperature signal is supplied to the main body unit control block 103 and the fan unit control block 107, for example. When the control is performed, the main body unit control block 103 and the fan unit control block 107 can refer to the temperature which is specified by the temperature signal.

A human sensor 115 is connected to the control unit 101. The human sensor 115 is attached to the indoor unit 12, for example. The human sensor 115 detects the presence or the absence of a human being in a room or a position of the human being in the room. The human sensor 115 outputs a detection signal in accordance with a detection result. The presence or the absence, or the position of the human being in the room is specified by the detection signal. The detection signal is supplied to the cooling/heating establishment section 102, the main body unit control block 103, and the fan unit control block 107, for example. When the control is performed, the cooling/heating establishment section 102, the main body unit control block 103, and the fan unit control block 107 can refer to the presence or the absence, or the position of the human being in the room which is specified by the detection signal.

The control unit 101 is provided with a storage section 116. Wind direction reference data is stored in the storage section 116. The wind direction reference data includes five sets of data groups, such as a "rightward set", a "slightly rightward set", a "frontward set", a "slightly leftward set", and a "leftward set". As illustrated in FIG. 11, in each set, reference positions (reference postures) of the left and right wind direction plates 39 of the first air outlet 31, the fan unit wind direction plates 57 of the fan unit 26 on the right side, and the fan unit wind direction plates 57 of the fan unit 26 on the left side, are designated. The reference positions of the left and right wind direction plates 39 are specified around the rotation shaft line 41. The reference positions of each fan unit wind direction plate 57 are specified around the rotation shaft 88. For example, when the left and right wind direction plates driving source 43 or the left and right wind direction plates driving source 94 is configured of a stepping motor, each reference position is specified by the number of pulses from an original position. In the drawing, the described angles D°, F°, and G° are examples, and it is possible to appropriately determine the angle in accordance with structures or other factors of the main body unit 25 or the fan unit 26. In particular, when a structure of the first air outlet 31 of the first blower fan 27 is not bilaterally symmetrical, it is preferable to make the left and the right of the angle of the wind direction of the left and right fan units 26 different from each other. Here, the angle of the wind direction plates of the left and right fan units 26 is set to be bilaterally symmetrical, and F° and G° are set to be smaller (for example, 80°) than D° (=90°). An angle $\alpha$ and an angle $\beta$ are angles in a case where the wind direction is changed frontward. The angle $\beta$ is set to be an angle (for example, $2\alpha$) which is greater than the angle $\alpha$. In addition, the storage section 116 may be externally attached to the control unit 101. Here, in a case of the "slightly rightward" or the "slightly leftward", the left and right wind direction plates 39 and the fan unit wind direction plates 57 are moved by the angle $\alpha$ frontward. However, the angle of the left and right wind direction plates 39 and the angle of the fan unit wind direction plates 57 may be different from each other. In a case of the "rightward" or the "leftward", the situation is also the same.

In addition, the control unit 101 can be configured of a calculation processing circuit which is referred to as a microprocessor unit (MPU), for example. A nonvolatile storage device can be built in and can be externally attached to the calculation processing circuit, for example. A predetermined control program can be stored in the storage device. The calculation processing circuit can function as the control unit 101 by executing the control program. In addition, the light receiving element 113, the room temperature sensor 114, and the human sensor 115 are set to be on a front surface side of the main housing 63*a*.

Next, operations of the air conditioner 11 will be described. For example, when the cooling operation is set, the cooling/heating establishment section 102 outputs the control signal which establishes the operation of the cooling operation. The control signal is supplied to the compressor 15 or the expansion valve 17, and the four-way valve 18. The four-way valve 18 connects the second port 18*b* and the third port 18*c* to each other, and connects the first port 18*a* and the fourth port 18*d* to each other. The refrigerant circulates in the refrigerant circuit 19 in accordance with the operation of the compressor 15. As a result, cool air is generated by the indoor heat exchanger 14. The temperature of the cool air is lower than at least the temperature of the indoor air. The operation of the compressor 15 is controlled in accordance with the room temperature which is detected by the room temperature sensor 114. In addition, for example, when the human sensor 115 detects that the human being is not present in the room for a predetermined period, the compressor 15 may stop.

The first blower fan control section 104 of the main body unit control block 103 outputs the first driving signal which drives the first blower fan 27. The first driving signal is supplied to the first blower fan driving source 62. The first blower fan 27 rotates. The airflow of cool air is blown out of the first air outlet 31. At this time, the upper and lower wind direction plates control section 105 of the main body unit control block 103 outputs the control signal which drives the upper and lower wind direction plates 32*a* and 32*b* of the main body unit 25. The control signal is supplied to the upper and lower wind direction plates driving source 36. Horizontal postures of the upper and lower wind direction plates 32*a* and 32*b* are established. As illustrated in FIG. 12, the upper and lower wind direction plates 32*a* and 32*b* induces an airflow 121 to be blown out of the first air outlet 31. The cool airflow 121 is blown out of the first air outlet 31 in the horizontal direction.

Here, the first blower fan control section 104 is set to be in an "automatic control mode". In the automatic control mode, the air volume of the first blower fan 27 is adjusted in accordance with a difference between the room temperature and a set temperature, for example. If the difference between the room temperature and the set temperature exceeds a first threshold value, the air volume of the first blower fan 27 is set to be the "strong". Rapid cooling is intended. If the difference between the room temperature and the set temperature is below the first threshold value, and exceeds a second threshold value which is lower than the first threshold value, the air volume of the first blower fan 27 is set to be the "weak". If the difference between the room temperature and the set temperature reaches below the second threshold value, the air volume of the first blower fan 27 is set to be the "very weak". The room temperature is maintained.

The second blower fan control section 108 of the fan unit control block 107 outputs the second driving signal which drives each centrifugal fan 73. The second driving signal is separately supplied to each second blower fan driving source 75. The centrifugal fan 73 rotates. The indoor air is sucked in the space in the fan housing 49 from the second suction port 52 by the fan unit 26. The temperature of the indoor air is equivalent to the room temperature. The sucked-in indoor air is blown out of the second air outlet 56 of the fan unit 26. At this time, the temperature of the indoor air is maintained to be the room temperature by the fan unit 26. The heat exchanger is not exposed. The housing posture control section 109 of the fan unit control block 107 outputs the third driving signal which drives the fan housing 49 around the horizontal shaft line 51. The third driving signal is supplied to the enclosure driving source 86 by each fan unit 26. For example, as illustrated in FIG. 12, the posture of the fan housing 49 can be changed downward from the horizontal posture. The fan housing 49 can induce an airflow 122 to be blown out of the second air outlet 56 downward from the horizontal direction. The airflow 122 (hereinafter, referred to as an "airflow 122 of the room temperature air") of the indoor air is blown out of the second air outlet 56 downward.

Here, the second blower fan control section 108 selectively sets the air volume of the centrifugal fan 73 in accordance with the command signal which is supplied from the light receiving element 113. In other words, air-blowing of the fan unit 26 is adjusted in accordance with the operation of the remote control unit. A human being in the room M can select the air volume of the fan unit 26 among the "strong", the "weak", and the "very weak" in accordance with preference. When the human being in the room M selects the air volume of the fan unit 26 among the "strong", the "weak", and the "very weak", the first blower fan control section 104 and the second blower fan control section 108 establish an "independent mode". In the "independent mode", the second blower fan control section 108 is independent from the air volume of cool air which is blown out of the first air outlet 31, and controls the air volume of the room temperature air which is blown out of the second air outlet 56. At this time, the "automatic control mode" of the first blower fan 27 is maintained regardless of the operation of the remote control unit. The human being in the room M can set the air volume of the centrifugal fan 73 regardless of the air volume of the first blower fan 27. The operations of the two fan units 26 may be interconnected.

In general, the indoor unit 12 is installed at a comparatively high position in the room. If the cool airflow 121 is induced in the horizontal direction, the cool air descends toward a floor surface from a high position. In the room, the cool air gradually accumulates. The entire indoor temperature environment is regulated by the cool air. At this time, the fan unit 26 makes the airflow 122 of the room temperature air directly oriented to the human being in the room M. The fan unit 26 can function as a substitute of a so-called electric fan when the cooling operation is operated. It is possible to prevent the cool air from being mixed in the airflow 122 of the room temperature air. As a result, the human being in the room M does not feel too cold, and can obtain a pleasant cool feeling. In addition to the cool feeling based on a decrease in the indoor temperature, the human being in the room M can obtain the cool feeling based on vaporization of the heat which is generated by the airflow 122.

In this manner, when the first blower fan control section 104 and the second blower fan control section 108 establish the independent mode, the human being in the room M can set the air volume of the second air outlet 56 and (or) the air direction of the airflow which is blown out of the second air outlet 56, regardless of the air volume of the first air outlet 31. Regardless of the setting by the human being in the room M, the air volume of cool air can be maintained. The human being in the room M can locally adjust the temperature environment by using the air volume and (or) the air direction of the room temperature air which is blown out of the second air outlet 56. In addition, the indoor air can be stirred by the room temperature air which is blown out of the second air outlet 56.

Here, the main body unit control block 103 obtains the wind direction reference data of the "frontward set" from the storage section 116. The posture of the left and right wind direction plates 39 is set to be the angle D° (=90°). The cool airflow 121 flows from the first air outlet 31 toward the front surface in the horizontal direction. The left and right wind directions of the first air outlet 31 are fixed. Meanwhile, the wind direction of the second air outlet 56 can be swung across a predetermined angular range in the horizontal direction. For example, the posture of the fan unit wind direction plate 57 can go back and forth between angles ($F°-\alpha$) and ($G°+\alpha$) of the "slightly rightward set", and angles ($F°+\alpha$) and ($G°-\alpha$) of the "slightly leftward set", around the angles F° and G° of the "frontward set". In this case, the fan unit control block 107 may obtain the wind direction reference data of the "slightly rightward set" and the "slightly leftward set" at the same time from the storage section 116. In this manner, the airflow from the second air outlet 56 can be evenly blown out across a wide range. Similarly, the posture of the fan unit wind direction plate 57 may go back and forth between angles ($F°-\beta$) and ($G°+\beta$) of the "rightward set", and angles ($F°+\beta$) and ($G°-\beta$) of the "leftward set" around the angles F° and G° of the "frontward set". In this manner, the wind direction of the second air outlet 56 is controlled by being independent from the wind direction of the first air outlet 31. The interconnection between the wind direction of the first air outlet 31 and the wind direction of the second air outlet 56 is released. The airflow 122 of the room temperature air can be directly oriented to the human being in the room M regardless of the wind direction of cool air. As a result, the human being in the room M can obtain a pleasant cool feeling. Meanwhile, when the skin of the human being in the room M is directly touched by the cool airflow 121, there is a case where the human being in the room M can feel unpleasant.

For example, as illustrated in FIG. 13, when the indoor unit 12 is installed on a left end toward a wall surface 124 which corresponds to a short side in the a longitudinal room 123 when the indoor unit 12 is viewed from far above, the control unit 101 can change the wind direction reference data to the "slightly rightward set" from the general "frontward set". Such a change may be indicated to the control unit 101 in accordance with the operation of the remote control unit, for example. Such an operation may be performed by a user at any time after positioning the indoor unit 12. A notification signal is supplied to the control unit 101 from the light receiving element 113 in accordance with the operation. The notification signal includes information which specifies the positioning position of the indoor unit 12. According to the information, the main body unit control block 103 obtains the wind direction reference data of the "slightly rightward set" from the storage section 116. The posture of the left and right wind direction plates 39 is changed from the angle D° (=90°) to the angle (D°−α). Here, α=20° is set. In this manner, the left and right wind direction plates control section 106 restricts the wind direction of the first air outlet 31 in a designated range. The wind direction of the cool air is restricted in accordance with the positioning position in the room 123. The cool airflow 121 can flow toward a position which is away from an indoor wall 125 on both sides. The cool air can excellently flow in the room 123 without being disturbed by the indoor wall 125. In this manner, it is possible to realize effective air-blowing in accordance with the positioning position of the indoor unit 12 in the room 123. In this case, the wind direction of the second air outlet 56 may also be controlled by being independent from the wind direction of the first air outlet 31. The interconnection between the wind direction of the first air outlet 31 and the wind direction of the second air outlet 56 is released. When the indoor unit 12 is installed on a right side toward the wall surface 124 which corresponds to the short side in the longitudinal room 123, the control unit 101 may similarly adjust the wind direction based on the angle of the "slightly leftward set".

Similarly, the fan unit control block 107 obtains the wind direction reference data of the "slightly rightward set" from the storage section 116. The angles of the postures of the fan unit wind direction plates 57 respectively change from the angles F° and G° to the angles (F°−α) and (G°+α). Here, F°=G°=80° is set. In this manner, the left and right wind direction plates control section 111 restricts the wind direction of the airflow which is blown out of the second air outlet 56 in the designated range. The wind direction of the room temperature air which is blown out of the second air outlet 56 is restricted in accordance with the positioning position in the room 123. The airflow 122 of the room temperature air can flow toward the position which is away from the indoor wall 125 on both sides. Even when the wind direction of the cool air is restricted in a certain range, air-blowing from the second air outlet 56 can be effectively used.

The wind direction of the second air outlet 56 is swung across a predetermined angle range in the horizontal direction. For example, the posture of the fan unit wind direction plate 57 can go back and forth between the angle of the "rightward set" and the angle of the "frontward set" around the "slightly rightward set". In this case, the fan unit control block 107 may obtain the wind direction reference data of the "rightward set" and the "frontward set" at the same time from the storage section 116. In this manner, even when the airflow from the second air outlet 56 is blown out across a wide range, the wind direction of the airflow which is blown out of the second air outlet 56 can be restricted in accordance with the positioning position of the indoor unit 12. As a result, the airflow 122 of the room temperature air from the second air outlet 56 can flow toward the position which is away from the indoor wall 125. The room temperature air from the second air outlet 56 can excellently flow in the room without being disturbed by the indoor wall 125. In this manner, it is possible to realize effective air-blowing in accordance with the positioning position of the indoor unit 12 in the room 123. When the indoor unit 12 is installed on a right side toward the wall surface 124 which corresponds to the short side in the longitudinal room 123, the control unit 101 may similarly adjust the wind direction based on the angle of the "slightly leftward set".

For example, as illustrated in FIG. 14, when the indoor unit 12 is installed on a left end toward the reflection member 128 which corresponds to a long side in a lateral room 127 when the indoor unit 12 is viewed from far above, the control unit 101 can change the wind direction reference data to the "rightward set" from the general "frontward set". The main body unit control block 103 obtains the wind direction reference data of the "rightward set" from the storage section 116. The posture of the left and right wind direction plates 39 is changed from the angle D° (=90°) to the angle (D°−β). Here, β=40° is set. In this manner, the left and right wind direction plates control section 106 restricts the wind direction of the first air outlet 31 in a designated range. The wind direction of the cool air is restricted in accordance with a positioning position in the room 127. The cool airflow 121 can flow toward a position which is away from an indoor wall 129 on both sides. The cool air can excellently flow in the room 127 without being disturbed by the indoor wall 129. In this manner, it is possible to realize effective air-blowing in accordance with the positioning position of the indoor unit 12 in the room 127. In this case, the wind direction of the second air outlet 56 may also be controlled by being independent from the wind direction of the first air outlet 31. The interconnection between the wind direction of the first air outlet 31 and the wind direction of the second air outlet 56 is released. When the indoor unit 12 is installed on a right side toward the wall surface 128 which corresponds to the long side in the lateral room 127, the control unit 101 may similarly adjust the wind direction based on the angle of the "slightly leftward set".

Similarly, the fan unit control block 107 obtains the wind direction reference data of the "rightward set" from the storage section 116. The angles of the postures of the fan unit wind direction plates 57 respectively change to the angles (F°−β) and (G°+β). In this manner, the left and right wind direction plates control section 111 restricts the wind direction of the airflow which is blown out of the second air outlet 56 in the designated range. The wind direction of the room temperature air which is blown out of the second air outlet 56 is restricted in accordance with the positioning position in the room. The airflow 122 of the room temperature air can flow toward the position which is away from the indoor wall 129 on both sides. Even when the wind direction of the cool air is restricted in a certain range, air-blowing from the second air outlet 56 can be effectively used. Similarly to the description above, the wind direction of the second air outlet 56 can be swung across the predetermined angle range in the horizontal direction. For example, the posture of the fan unit wind direction plate 57 can go back and forth between the angle of the "rightward set" and the angle of the "frontward set" around the "slightly rightward set". When the indoor unit 12 is installed on a right side toward the wall surface 128 which corresponds to the long side in the lateral room 127, the control unit 101 may similarly adjust the wind direction based on the angle of the "slightly leftward set".

Above, an example, in which the orientation of the left and right wind direction plates 39 provided in the first air outlet 31 is fixed in accordance with the blowing-out direction, and the fan unit wind direction plate 57 provided in the second air outlet 56 is swung across the predetermined range in accordance with the orientation of the left and right wind direction plates 39, is described. This is control which is mainly performed when the cooling operation is performed. Indoor temperature adjustment is performed by the air which is blown out of the first air outlet 31, and the indoor air can be stirred by the air which is blown out of the second air outlet 56. In addition, an initial position of the left and right wind direction plates 39 and the fan unit wind direction plate 57 may be set to be different from each other. Specifically, the left and right wind direction plates 39 may be set to be the "frontward set", and the fan unit wind direction plate 57 may be set to be the "slightly rightward set". In addition, as illustrated in FIG. 11, the left and right wind direction plates 39 and the fan unit wind direction plate 57 may fluctuate at the same time. In addition, the orientations of the left and right wind direction plates 39 and the fan unit wind direction plate 57 may be set separately.

When the human being in the room M desires silence in the room, the human being in the room M can select the "quiet" as the air volume of the fan unit 26. When the "quiet" is selected in this manner, the first blower fan control section 104 and the second blower fan control section 108 establish an "interconnection mode". In the "interconnection mode", the first blower fan control section 104 is associated with the air volume of the room temperature air which is blown out of the second air outlet 56, and controls the air volume of cool air which is blown out of the first air outlet 31. The second blower fan control section 108 sets the air volume of the second air outlet 56 to be the "quiet" in accordance with the selection of the "quiet". The air volume of the second air outlet 56 becomes smaller than the air volume of the "very weak". In other words, the air volume of the room temperature air is outside the range including the "strong", the "weak", and the "very weak", to a lower side. As a result of reducing the air volume in this manner, wind sound of the airflow 122 which is blown out of the second air outlet 56 weakens. In conjunction with this, the first blower fan control section 104 releases the "automatic control mode" of the first blower fan 27. The first blower fan control section 104 sets the air volume of the first air outlet 31 to be the "quiet". The air volume of the first air outlet 31 similarly weakens. The wind sound of the airflow which is blown out of the first air outlet 31 weakens. In this manner, it is possible to establish a tranquil environment in the room.

When the human being in the room M desires rapid cooling in the room, the human being in the room M can select a "rapid cooling" as the air volume of the fan unit 26. When the "rapid cooling" is selected in this manner, the first blower fan control section 104 and the second blower fan control section 108 similarly establish the "interconnection mode". The second blower fan control section 108 sets the air volume of the second air outlet 56 to be the "super strong" in accordance with the selection of the "rapid cooling". The air volume of the second air outlet 56 becomes stronger than the air volume of the "strong". In other words, the air volume of the room temperature air is out of the range including the "strong", the "weak", the "very weak", to an upper side. In conjunction with this, the first blower fan control section 104 releases the "automatic control mode" of the first blower fan 27. The first blower fan control section 104 sets the air volume of the first air outlet 31 to be the "super strong". The air volume of the first air outlet 31 similarly becomes strong. In this manner, it is possible to rapidly perform cooling in the room.

For example, when the heating operation is set, the cooling/heating establishment section 102 outputs the control signal which establishes the operation of the heating operation. The control signal is supplied to the compressor 15 or the expansion valve 17, and the four-way valve 18. The four-way valve 18 connects the second port 18*b* and the fourth port 18*d* to each other, and connects the first port 18*a* and the third port 18*c* to each other. The refrigerant circulates in the refrigerant circuit 19 in accordance with the operation of the compressor 15. As a result, warm air is generated by the indoor heat exchanger 14. The temperature of the warm air is higher than at least the temperature of the indoor air. The operation of the compressor 15 is controlled in accordance with the room temperature which is detected by the room temperature sensor 114. For example, when the human sensor 115 detects that the human being is not present for a predetermined period, the compressor 15 may stop.

In the heating operation, the warm airflow is blown out of the first air outlet 31 in accordance with the rotation of the first blower fan 27. At this time, the upper and lower wind direction plates control section 105 of the main body unit control block 103 supplies the control signal to the upper and lower wind direction plates driving source 36, and establishes the postures of the upper and lower wind direction plates 32*a* and 32*b* downward. As illustrated in FIG. 15, the upper and lower wind direction plates 32*a* and 32*b* induce an airflow 131 to be blown out of the first air outlet 31 toward the floor surface downward. The warm airflow 131 is blown out of the first air outlet 31 downward.

As illustrated in FIG. 15, the posture of the fan housing 49 is set slightly more upward than the upper and lower wind direction plates 32*a* and 32*b*. The fan housing 49 of the fan unit 26 establishes the posture of blowing out the airflow 122 of the room temperature air downward similarly to the upper and lower wind direction plates 32*a* and 32*b*, from a position which is higher than that of the first air outlet 31. However, as illustrated apparently in FIG. 11, as the angles F° and G° (here, F°=G°=80°) of the fan unit wind direction plate 57 are smaller than the angle D° of the left and right wind direction plates 39, the airflow 122 which is blown out of the two second air outlets 56 can widen in the horizontal direction while approaching each other. Then, the airflow 122 of the fan unit 26 forms a layer of the room temperature air in an upper space of the warm airflow 131. The airflow 122 of the room temperature air which is blown out of the second air outlet can collide with the warm airflow, and control the orientation and the movement of the warm airflow 131. The airflow 122 of the fan unit 26 can put the warm air between the airflow 122 and the floor surface. In this manner, the warm air is prevented from ascending. The warm air is sent into a desired location in the room. The human being in the room M can keep feeling the warm temperature at the ground level. As the room temperature reaches a certain temperature even though the room temperature is lower than the set temperature, the human being in the room M can avoid feeling chilly based on the airflow 122 of the room temperature air. The indoor temperature environment is efficiently regulated.

When the heating operation is performed, the control unit 101 obtains the wind direction reference data in each set such as the "frontward set". The angles F° and G° of the fan unit wind direction plate 57 in each set are associated with the angle D° of the left and right wind direction plates 39. Therefore, the control unit 101 can be interconnected to the posture of the left and right wind direction plates 39, and can adjust the posture of the fan unit wind direction plate 57. Regardless of the inclination of the left and right wind direction plates 39 which is called "α" or "β", an angular difference between the angles F° and G° of the fan unit wind direction plate 57 and the angle D° of the left and right wind direction plates 39 can be always maintained. As a result, regardless of the inclination of the left and right wind direction plates 39, a layer of the room temperature air can be formed to overlap with the above of the warm airflow 131. The airflow 122 of the room temperature air which is blown out of the second air outlet 56 can hold down the ascending warm air from above. The warm air can stay in the vicinity of the floor surface. In this manner, it is possible to send the warm air to the ground level of the human being in the room M. In particular, even when the wind direction of the warm air is limited, according to this, the wind direction of the second air outlet 56 is limited. Therefore, the warm air can be reliably held down along the floor surface.

Here, the wind direction of the airflow which is blown out of the first air outlet 31 is swung across the predetermined angle range in the horizontal direction. The posture of the left and right wind direction plates 39 goes back and forth between the angle (D°−α) of the "slightly rightward set" and the angle (D°+α) of the "slightly leftward set" around the angle D° of the "frontward set". When this control is performed, the main body unit control block 103 obtains the wind reference data of the "slightly rightward set" and the "slightly leftward set" at the same time from the storage section 116. In this manner, the warm air from the first air outlet 31 evenly spreads across a wide range.

At this time, the wind direction of the airflow which is blown out of the second air outlet 56 is interconnected to the wind direction of the airflow which is blown out of the first air outlet 31. The posture of the fan unit wind direction plate 57 goes back and forth between the angles (F°−α) and (G°+α) of the "slightly rightward set", and the angles (F°+α) and (G°−α) of the "slightly leftward set" around the angles F° and G° of the "frontward set". When this control is performed, the fan unit control block 107 obtains the wind direction reference data of the "slightly rightward set" and the "slightly leftward set" at the same time from the storage section 116. The left and right wind direction plates control section 111 changes the posture of the fan unit wind direction plate 57 at the same angle in the same direction as the angle and the direction of the left and right wind direction plates 39. As a result, a relative spatial position between the warm airflow 131 and the airflow 122 of indoor air can be maintained. Therefore, even when the wind direction of the airflow which is blown out of the first air outlet 31 is swung in the horizontal direction, the airflow 122 of indoor air which is blown out of the second air outlet 56 can reliably hold down the ascending warm air from above. The warm air can stay in the vicinity of the floor surface. In this manner, it is possible to reliably avoid unfavorable collision or excessive estrangement between the warm airflow 131 and the airflow 122 of indoor air.

When the posture of the left and right wind direction plates 39 changes from the angle D° (=90°) to the angle (D°−α) in accordance with the positioning position, the fan unit control block 107 obtains the wind direction reference data of the "slightly rightward set" from the storage section 116. The reference posture of the fan unit wind direction plate 57 changes from the angles F° and G° respectively to the angles (F°−α) and (G°+α). A swing of the fan unit wind direction plate 57 goes back and forth between the angles (F°−β) and (G°+β) of the "rightward set" and the angles F° and G° of the "frontward set" around the angles (F°−α) and (G°+α) of the "slightly rightward set". When this control is performed, the main body unit control block 103 obtains the wind reference data of the "rightward set" and the "frontward set" at the same time from the storage section 116. In this manner, the warm air from the first air outlet 31 evenly spreads across a wide range. Even when the posture of the left and right wind direction plates 39 changes from the angle D° to the angle (D°−β) in accordance with the positioning position, the posture of the fan unit wind direction plate 57 can be similarly controlled.

When the warm operation is operated, the human being in the room M can adjust the air volume of the warm air through the operation of the remote control unit. The human being in the room M can select the air volume of the warm air among the "strong", "weak", and "very weak" in accordance with preference. The first blower fan control section 104 selectively sets the air volume of the first blower fan 27 in accordance with the command signal which is supplied from the light receiving element 113. At the same time, the second blower fan control section 108 selectively sets the air volume of the centrifugal fan 73 in accordance with the command signal which is supplied from the light receiving element 113. In other words, when the air volume of the warm air is set to be the "strong", the air volume of the room temperature air which is blown out of the second air outlet 56 is set to be the "strong". When the air volume of the warm air is set to be the "weak", the air volume of the room temperature air which is blown out of the second air outlet 56 is set to be the "weak". When the air volume of warm air is set to be the "very weak", the air volume of the room temperature air which is blown out of the second air outlet 56 is set to be the "very weak". The air volume of the room temperature air which is blown out of the second air outlet 56 is smaller than the air volume of the warm air. Therefore, even when the airflow 122 of the room temperature air collides with the warm airflow 131, it is possible to avoid dissipation of the warm air. A mass of the warm air can be maintained. When the air volume of the room temperature air which is blown out of the second air outlet 56 is stronger than the air volume from the first air outlet 31, the warm airflow 131 is displaced by the airflow 122 of the room temperature air. Accordingly, the warm airflow 131 cannot be sufficiently transferred to the floor surface. The room temperature air flows along the floor surface, and the human being M cannot excellently feel the warm temperature.

When the heating operation is performed, the human being in the room M can change the air volume of the warm air through the operation of the remote control unit. The first blower fan control section 104 switches the air volume of the first blower fan 27 in accordance with the command signal which is supplied from the light receiving element 113. The second blower fan control section 108 switches the air volume of the room temperature air by following the change in the air volume of the first blower fan 27. In this manner, the air volume of the room temperature air which is blown out of the second air outlet 56 is maintained to be an air volume which is smaller than the air volume of the warm air. Even when the air volume of the warm air is changed in this manner, the warm air can reliably stay in the vicinity of the floor surface. The human being in the room M can adjust the air volume of the warm air in accordance with the change in the sensible temperature, and as a result, can excellently feel the warm temperature.

In addition, in the indoor unit 12 of the air conditioner 11, the second air outlet 56 is open with a certain area which is smaller than that of the first air outlet 31. Therefore, the fan housing 49 can be formed in a smaller size compared to the structural body 28. As a result, the entire indoor unit 12 can be small in size. As the air volume of the second air outlet 56 is small, the fan housing 49 can avoid an increase in wind sound even when the size is small.

REFERENCE SIGNS LIST

12: Air conditioner (indoor unit), 14: Heat exchanger (indoor heat exchanger), 27: First blower fan, 28: Structural body, 31: First air outlet, 49: Auxiliary housing (fan housing), 56: Second air outlet, 65: Wall body, 73: Second blower fan (centrifugal fan), 101: Control circuit (control unit), 104: First blower fan control section, 108: Second blower fan control section, 121: Cool airflow, 131: Warm airflow

The invention claimed is:

1. An air conditioner, comprising:

a first enclosure comprising a first airflow passage in which a heat exchanger and a first blower fan are disposed, the first enclosure comprising a first air outlet at an end of the first airflow passage, the heat exchanger heat-exchanging with indoor air to generate cool air being lower in temperature than the indoor air, the first blower fan inducing an airflow of the cool air in the first airflow passage, the airflow of the cool air being discharged through the first air outlet at the end of the first airflow passage;

a second enclosure rotatably disposed on a first side of the first enclosure, the second enclosure comprising a second airflow passage in which a second blower fan is disposed, the second airflow passage being isolated from the first airflow passage, the second enclosure comprising a second air outlet at an end of the second airflow passage, the second blower fan inducing a first airflow of the indoor air, the first airflow of the indoor air being discharged through the second air outlet such that the first airflow of the indoor air discharged through the second air outlet collides with the airflow of the cool air discharged through the first air outlet;

a third enclosure rotatably disposed on a second side opposite the first side of the first enclosure, the third enclosure comprising a third airflow passage in which a third blower fan is disposed, the third airflow passage being isolated from the first airflow passage and the second airflow passage, the third enclosure comprising a third air outlet at an end of the third airflow passage, the third blower fan inducing a second airflow of the indoor air, the second airflow of the indoor air being discharged through the third air outlet such that the second airflow of the indoor air discharged through the third air outlet collides with the airflow of the cool air discharged through the first air outlet; and a control circuit configured to control operation of the first blower fan, the second blower fan, and the third blower fan so that wind speeds of the first airflow of the indoor air discharged through the second air outlet and the second airflow of the indoor air discharged through the third air outlet are higher than a wind speed of the airflow of the cool air discharged through the first air outlet.

2. The air conditioner according to claim 1, wherein the second air outlet and the third air outlet each comprises an opening area which is smaller than an opening area of the first air outlet.

3. A control circuit for an air conditioner having an indoor unit, the indoor unit comprising:

a first enclosure comprising a first airflow passage in which a heat exchanger and a first blower fan are disposed, the first enclosure comprising a first air outlet at an end of the first airflow passage, the heat exchanger heat-exchanging with indoor air to generate either cool air being lower in temperature than the indoor air or warm air being higher in temperature than the indoor air, the first blower fan inducing an airflow of the cool air or the warm air in the first airflow passage, the airflow of the cool air or the warm air being discharged through the first air outlet at the end of the first airflow passage;

a second enclosure rotatably disposed on a first side of the first enclosure, the second enclosure comprising a second airflow passage in which a second blower fan is disposed, the second airflow passage being isolated from the first airflow passage, the second enclosure comprising a second air outlet at an end of the second airflow passage, the second blower fan inducing a first airflow of the indoor air, the first airflow of the indoor air being discharged through the second air outlet such that the first airflow of the indoor air discharged through the second air outlet collides with the airflow of the cool air or the warm air discharged through the first air outlet;

a third enclosure rotatably disposed on a second side opposite the first side of the first enclosure, the third enclosure comprising a third airflow passage in which a third blower fan is disposed, the third airflow passage being isolated from the first airflow passage and the second airflow passage, the third enclosure comprising a third air outlet at an end of the third airflow passage, the third blower fan inducing a second airflow of the indoor air, the second airflow of the indoor air being discharged through the third air outlet such that the second airflow of the indoor air discharged through the third air outlet collides with the airflow of the cool air or the warm air discharged through the first air outlet; and wherein the control circuit comprising:

a first blower fan controller configured to control the first blower fan to cause the airflow of the cool air or the warm air discharged through the first air outlet at a first wind speed; and a second blower fan controller configured to control the second blower fan and the third blower fan to cause the first airflow of the indoor air discharged through the second air outlet and the second airflow of the indoor air discharged through the third air outlet at a wind speed which is higher than the first wind speed.

4. An air conditioner, comprising:

a first enclosure comprising a first airflow passage in which a heat exchanger and a first blower fan are disposed, the first enclosure comprising a first air outlet at an end of the first airflow passage, the heat exchanger heat-exchanging with indoor air to generate warm air being higher in temperature than the indoor air, the first blower fan inducing an airflow of the warm air in the first airflow passage, the airflow of the warm air being discharged through the first air outlet at the end of the first airflow passage;

a second enclosure rotatably disposed on a first side of the first enclosure, the second enclosure comprising a second airflow passage in which a second blower fan is disposed, the second airflow passage being isolated from the first airflow passage, the second enclosure comprising a second air outlet at an end of the second airflow passage, the second blower fan inducing a first airflow of the indoor air, the first airflow of the indoor air being discharged through the second air outlet such that the first airflow of the indoor air discharged through the second air outlet collides with the airflow of the warm air discharged through the first air outlet;

a third enclosure rotatably disposed on a second side opposite the first side of the first enclosure, the third enclosure comprising a third airflow passage in which a third blower fan is disposed, the third airflow passage being isolated from the first airflow passage and the second airflow passage, the third enclosure comprising a third air outlet at an end of the third airflow passage, the third blower fan inducing a second airflow of the indoor air, the second airflow of the indoor air being discharged through the third air outlet such that the second airflow of the indoor air discharged through the third air outlet collides with the airflow of the warm air discharged through the first air outlet; and a control circuit configured to control operation of the first blower fan, the second blower fan, and the third blower fan so that wind speeds of the first airflow of the indoor air discharged through the second air outlet and the second airflow of the indoor air discharged through the third air outlet are higher than a wind speed of the airflow of the warm air discharged through the first air outlet.

5. The air conditioner according to claim 4, wherein the control circuit is configured to output a control signal setting a posture of the second enclosure and the third enclosure so that the first airflow of the indoor air discharged through the second air outlet and the second airflow of the indoor air discharged through the third air outlet are directed towards a space above the airflow of the warm air discharged through the first air outlet in a heating operation of the air conditioner.

6. The air conditioner according to claim 5, wherein the control circuit is configured to control the wind speeds of the first airflow of the indoor air discharged through the second air outlet and the second airflow of the indoor air discharged through the third air outlet in the heating operation so that the wind speeds of the first airflow of the indoor air discharged through the second air outlet and the second airflow of the indoor air discharged through the third air outlet in the heating operation are maintained to be higher than the wind speed of the airflow of the warm air.

7. The air conditioner according to claim 6, wherein the control circuit is configured to control the wind speeds of the first airflow of the indoor air discharged through the second air outlet and the second airflow of the indoor air discharged through the third air outlet in the heating operation to follow a change in the wind speed of the airflow of the warm air.

* * * * *